US006497072B2

(12) United States Patent
Fries

(10) Patent No.: US 6,497,072 B2
(45) Date of Patent: Dec. 24, 2002

(54) SLIDING PANEL FOR LONGITUDINAL AND LATERAL MOVEMENT IN A FRAME STRUCTURE

(75) Inventor: Bror Fries, Hishult (SE)

(73) Assignee: Frip AB, Hishult (SE)

( * ) Notice: Subject to any disclaimer, the term of this patent is extended or adjusted under 35 U.S.C. 154(b) by 0 days.

(21) Appl. No.: 10/032,594

(22) Filed: Dec. 27, 2001

(65) Prior Publication Data

US 2002/0053166 A1 May 9, 2002

Related U.S. Application Data

(63) Continuation of application No. 09/331,984, filed as application No. PCT/NO98/00006 on Jan. 9, 1998.

(30) Foreign Application Priority Data

Jan. 10, 1997 (NO) ..... 970128

(51) Int. Cl.[7] ..... E06B 3/46

(52) U.S. Cl. ..... 49/209; 49/213; 49/214; 49/410; 49/409; 296/146

(58) Field of Search ..... 49/208, 209, 210, 49/211, 213, 214, 276, 277, 278, 409, 410, 425; 292/9, 36, 145, 146, 218

(56) References Cited

U.S. PATENT DOCUMENTS

| | | | | | |
|---|---|---|---|---|---|
| 286,909 | A | * | 10/1883 | Commander | 292/218 |
| 705,081 | A | * | 7/1902 | Hennessey | 16/90 |
| 1,490,905 | A | * | 4/1924 | Ballard | 49/209 |
| 1,597,682 | A | * | 8/1926 | Hagstom | 292/36 |
| 1,636,241 | A | * | 7/1927 | Polachek et al. | 49/209 |
| 1,719,203 | A | * | 7/1929 | Taussig | 70/100 |
| 2,146,633 | A | * | 2/1939 | Leonard | 292/47 |
| 3,327,428 | A | * | 6/1967 | Horton et al. | 49/177 |
| 3,334,375 | A | * | 8/1967 | Hubbard | 16/97 |
| 3,538,642 | A | * | 11/1970 | Fredricksen | 49/213 |
| 3,611,637 | A | * | 10/1971 | Saino | 49/235 |
| 3,660,936 | A | * | 5/1972 | Bryson | 49/209 |
| 3,953,061 | A | * | 4/1976 | Hansen et al. | 292/34 |
| 4,235,463 | A | * | 11/1980 | Benevenuta | 292/218 |
| 4,341,043 | A | * | 7/1982 | Yamamoto et al. | 49/209 |
| 4,688,352 | A | * | 8/1987 | Kinoshita | 49/209 |
| 5,351,442 | A | * | 10/1994 | Gingras | 49/411 |
| 5,437,484 | A | * | 8/1995 | Yamada | 292/336.3 |
| 5,724,770 | A | * | 3/1998 | McAfee | 49/404 |

FOREIGN PATENT DOCUMENTS

| | | | | |
|---|---|---|---|---|
| AT | 258136 | * | 4/1990 | 49/214 |
| CA | 968225 | * | 5/1975 | 49/351 |
| CH | 212371 | * | 11/1940 | |
| CH | 588007 | * | 5/1977 | |
| DE | 2547336 | * | 11/1976 | |
| EP | 44799 | * | 1/1982 | 49/209 |
| EP | 409754 | * | 1/1991 | |
| EP | 733766 | * | 9/1996 | |
| GB | 1264314 | * | 2/1972 | |
| GB | 2194578 | * | 3/1988 | |
| GB | 2220700 | * | 1/1990 | |
| GB | 2239284 | * | 6/1991 | |
| GB | 2308404 | * | 6/1997 | |
| JP | 108778 | * | 4/1990 | 49/410 |
| NO | 104904 | * | 8/1964 | |
| NO | 115927 | * | 12/1968 | |
| SE | 446207 | * | 8/1986 | |
| WO | WO 96/25576 | * | 8/1996 | |

* cited by examiner

*Primary Examiner*—Gregory J. Strimbu
(74) *Attorney, Agent, or Firm*—Barry R. Lipsitz

(57) ABSTRACT

A device for supporting and guiding the movement, in both a longitudinal direction and a lateral direction, of a sliding panel in a frame structure by using guide tracks and vertically adjustable guide castors. The vertical position of the sliding panel is adjustable with the aid of a bogie-based carrying wheel mechanism. A locking mechanism with a specially designed striking plate assists longitudinal and sideways movement of the sliding panel into a locking position for locking of the sliding panel.

39 Claims, 24 Drawing Sheets

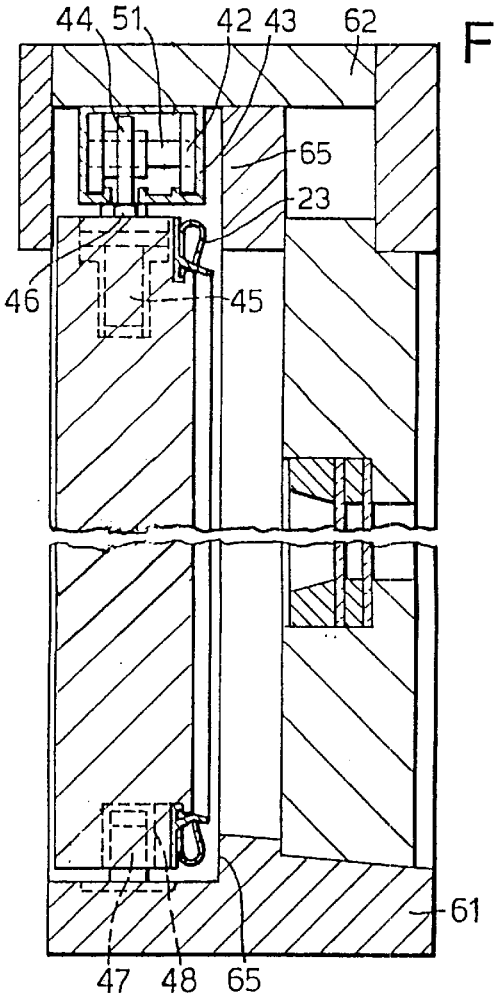
Fig.10.
Fig.9.
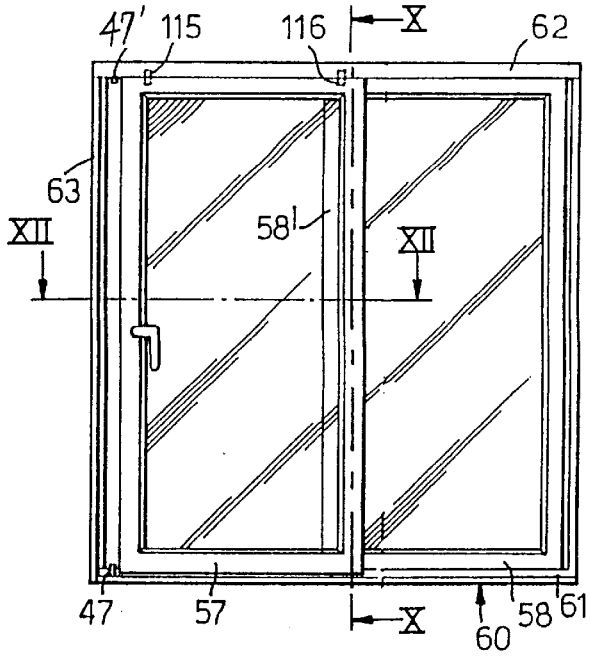
Fig.12.
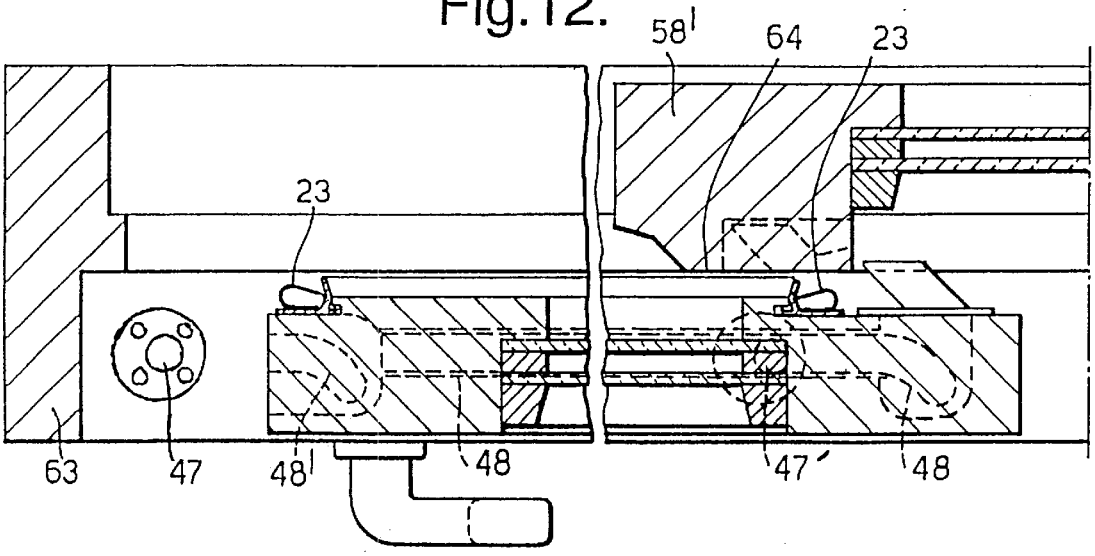

SLIDING PANEL FOR LONGITUDINAL AND LATERAL MOVEMENT IN A FRAME STRUCTURE

This application is a continuation of U.S. patent application Ser. No. 09/331,984 filed on Jun. 30, 1999, which was a U.S. national phase filing under 35 U.S.C. §371 of PCT/NO98/00006 filed on Jan. 9, 1998.

BACKGROUND OF THE INVENTION

The present invention relates to a device for longitudinal movement of a sliding panel, e.g., a sliding door or sliding window in a frame structure, and simultaneous lateral movement of the sliding panel at an end position region where the sliding panel closes an opening in the frame structure Furthermore, the invention relates to a locking device for a sliding panel which is movable in a frame structure either relative to a fixed element which forms a part of the frame structure or relative to a second sliding panel which is movable in the frame structure, said locking device having a lock case with a dead bolt adapted for a turning movement through 90° and located in the frame of the sliding panel, and a striking plate located in the frame structure.

Sliding doors and sliding windows having only sideways movement do not meet the sealing requirements that apply to doors or windows which are exposed to storms, wind and rain, especially driving rain. Nor is the sealing sufficient as regards fire or the passage of sound. Therefore, a sideways movement or depthwise movement of the sliding panel, such as a door or window, is required, whereby the weather stripping will be compressible against the frame rebate. If sealing can also be obtained at the corners of doors or windows, the sealing capacity is increased considerably. It is also important that the seal is attached equally firmly around the whole door or window.

Today, different methods are employed to provide this depthwise movement or sideways movement, such as gripping arms which close to either on sideways movement or by means of actuation by a handle in the closed position. Guiding channels which successively change the direction of movement from sideways to depthwise also exist. The invention described below belongs to the last category, but has several distinctive features and advantages which make it superior to the known structures.

The features characteristic for the invention of said sliding panel and said locking device are set forth in the patent claims below and in the description below with reference to the appended drawings.

BRIEF DESCRIPTION OF THE DRAWINGS

FIG. 9 shows a sliding panel which is movable in a frame structure relative to a fixed element.

FIG. 10 shows the section X—X in FIG. 9.

FIG. 12 shows the section XII—XII in FIG. 9.

DETAILED DESCRIPTION OF THE INVENTION

The invention will now be explained in more detail with reference to the drawings.

Figure 1:
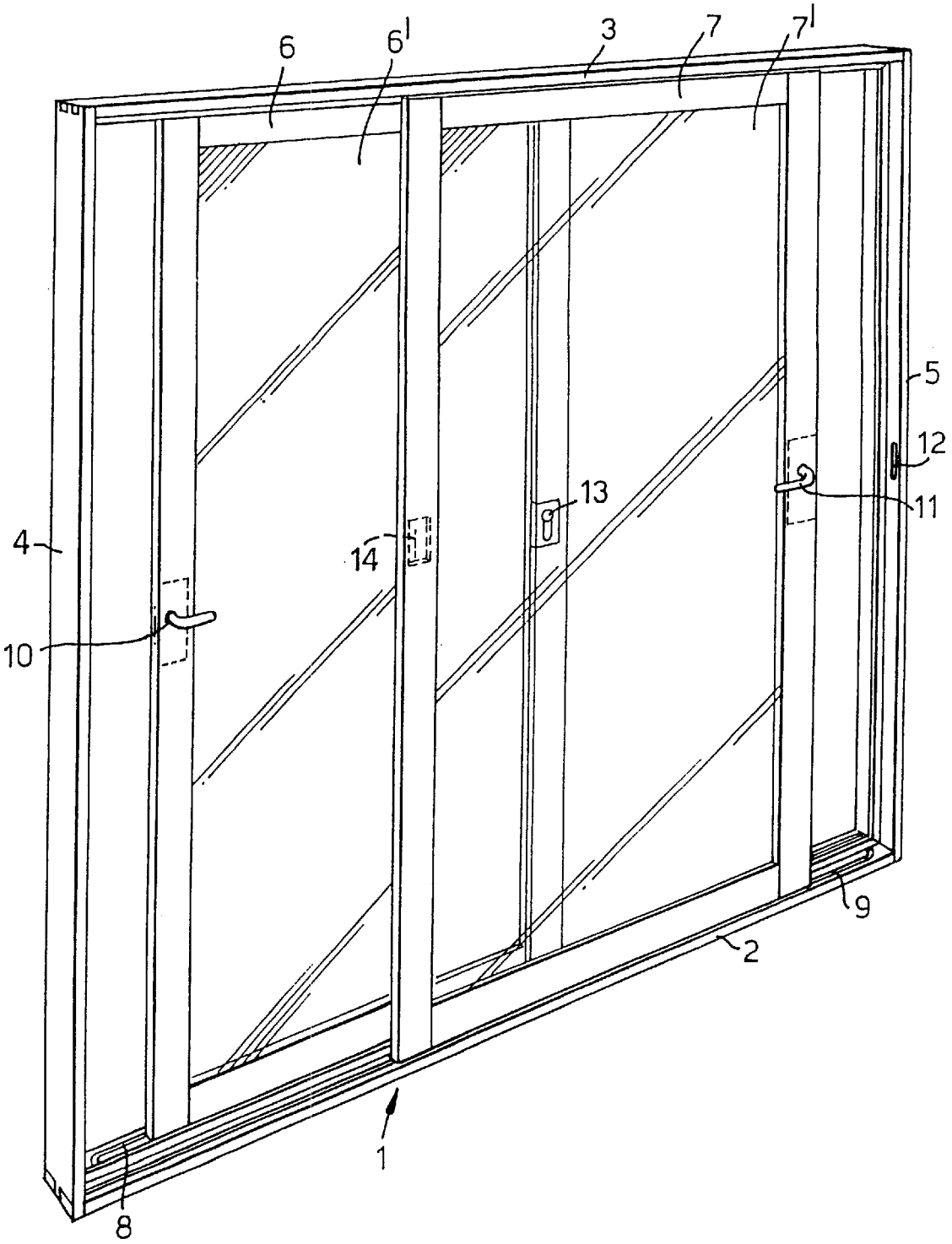
FIG. 1 shows, in an embodiment of the invention, a sliding panel which is movable relative to a second movable sliding panel in a frame structure.

FIG. 1 shows a frame structure 1 consisting of a sill member 2, a head member 3 and jambs 4, 5 at the ends of the sill member 2 and head member 3. In the illustrated case two sliding panels 6, 7 are provided. These may be opaque, translucent or transparent, i.e., provided with, e.g., glass areas 6', 7'. Thus, in the frame structure 1 there are thus two sliding panels 6, 7, in the case of the illustrated example in the form of sliding doors capable of moving relative to one another. Of course, it is also conceivable that one of the sliding panels, e.g., the panel 7 may replaced by a stationary panel mounted in the frame structure, whilst the other panel 6 is movable.

The sliding panels 6, 7 are guided to their desired movement by means of guide tracks 8, 9 as shown for the sill member 2. Corresponding guide tracks (not shown) will also be found in the downward facing side of the head member 3.

In a closed position it is important that the sliding panels can be locked relative to the frame structure 1. One end portion of the sliding panels 6, 7 is therefore preferably equipped with a lock case, indicated by means of the reference numerals 10 and 11 respectively in FIG. 1, and which can engage with a striking plate, such as the striking plate 12 for lock case 11. If there is a question of extra security, the opposite end of the sliding panel can be provided with a locking device consisting of a lock case 13 on the door which is closest to the inside of the house in which the sliding door construction is mounted and an associated striking plate 14 in the sliding door 7 that is outermost. If, for instance, the sliding door 7 is not movable but constitutes a stationary panel in the frame structure, as will be discussed later in connection with other embodiments of the invention, other locking means can be used instead of the lock case 13 and the striking plate 14.

Figure 3:
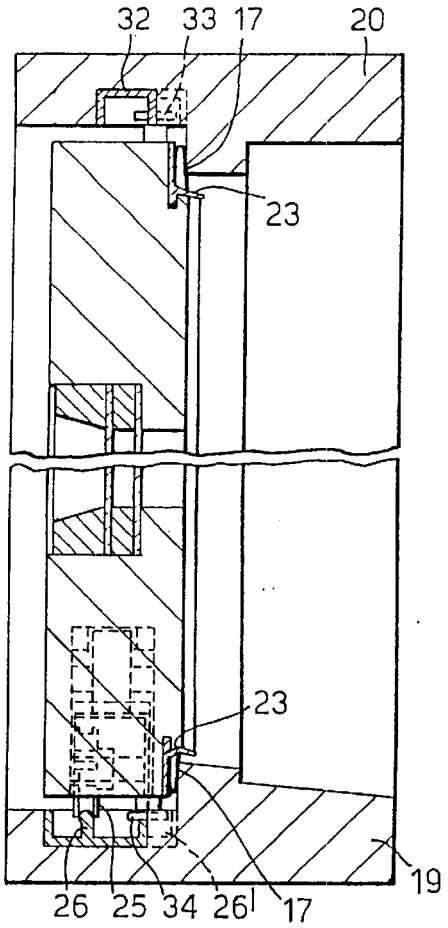
FIG. 3 shows the section III—III in FIG. 2.
Figure 2:
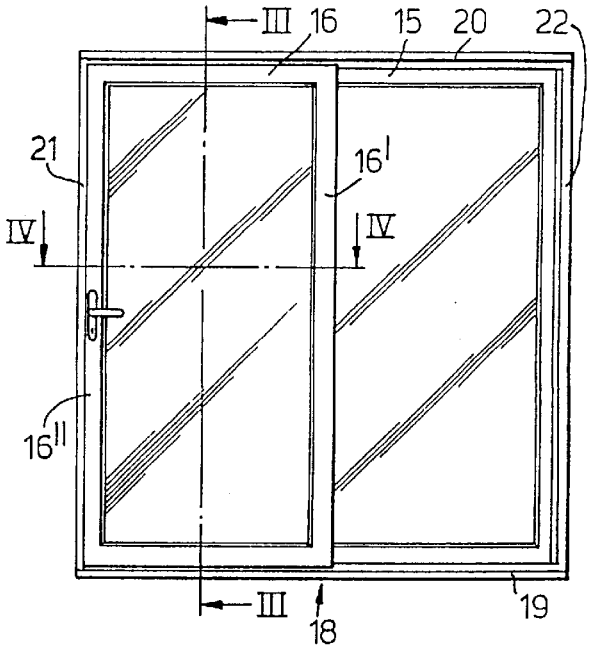
FIG. 2 shows, in a further embodiment of the invention, a sliding panel movable in a frame structure relative to a fixed element.
Figure 4:
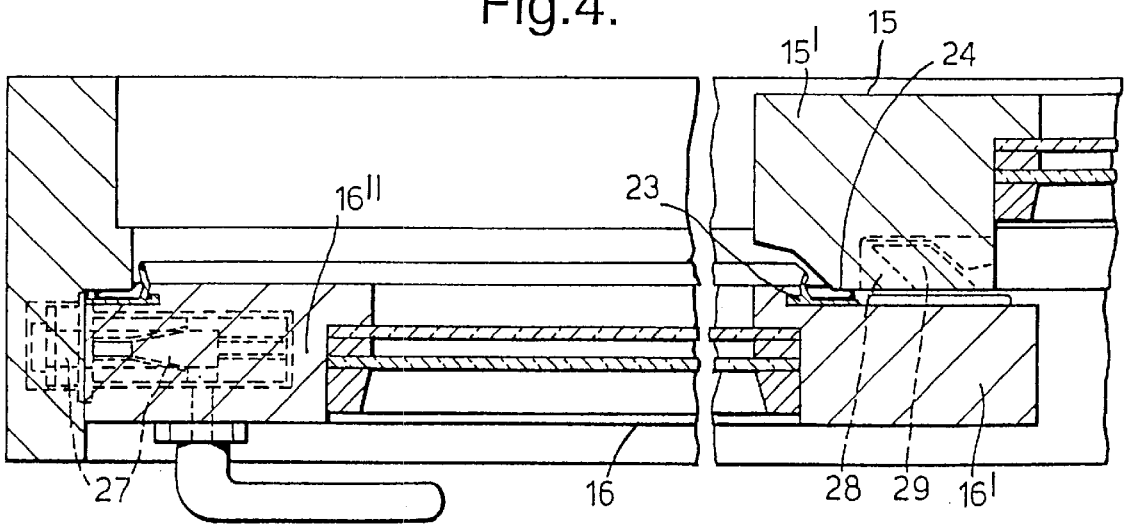
FIG. 4 shows the section IV—IV in FIG. 2

Although the construction as shown in FIG. 1 in certain cases may be advantageous, perhaps the most common sliding panel construction is fabricated having a stationary panel 15 and a movable sliding panel 16, related to a frame structure comprising a sill member 19, a head member 20 and jambs 21, 22 as shown in FIG. 2. If two sliding panels are employed, as shown in FIG. 1, it will be easier to clean the outside of the sliding panels. Irrespective of which version is chosen, i.e., either with two movable sliding panels 6, 7, as shown in FIG. 1, or with one movable sliding panel 16 and a stationary panel 15, as in FIG. 2, it will be necessary to have a rebate 17 in the center of the frame 18, as shown in FIG. 3 for the sill member and head member 19, 20, respectively. However, it is also essential that an efficient seal can be made between the rear stile 16' of the sliding panel 16 and the adjacent stile 15' of the stationary panel 15 when the sliding panel 16 is in the closed position as is shown in FIGS. 2 and 4. To this end, the stile 15' is provided with a rebate 24 against which the weather stripping 23 of the sliding panel 16 bears.

Although the sliding panel construction as shown in FIGS. 1 and 2 has a frame structure 1; 18, this frame structure may conceivably be replaced by a floor, ceiling/ceiling rafter and opposite walls in a building structure. To be able to move at least one sliding panel, carrying wheels are necessary. There must be at least two carrying wheels for each sliding panel, preferably arranged at the end portions of the sliding panel.

Figure 32:
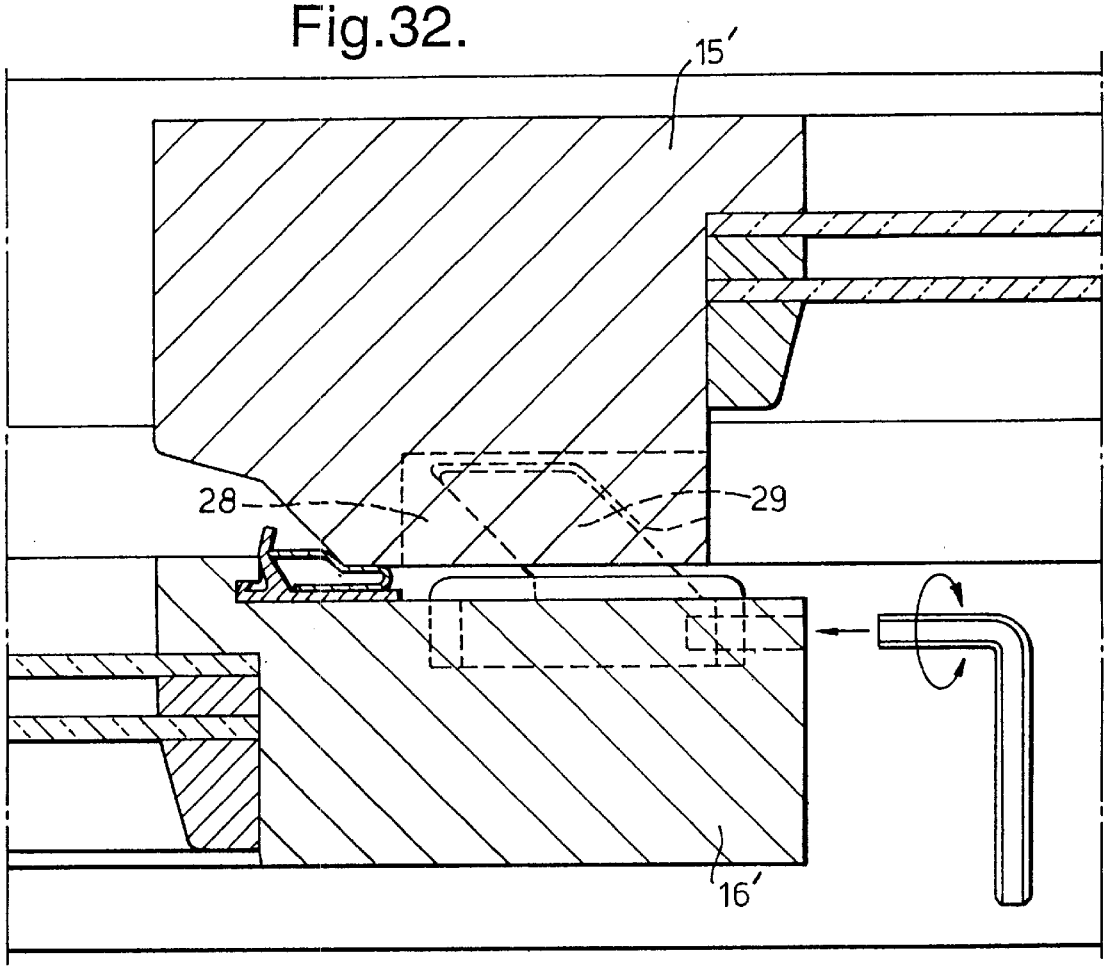
FIG. 32 illustrates the location and adjustability of a safety fitting for a sliding panel that is movable in a frame structure relative to a stationary panel element located in the frame structure.
Figure 33:
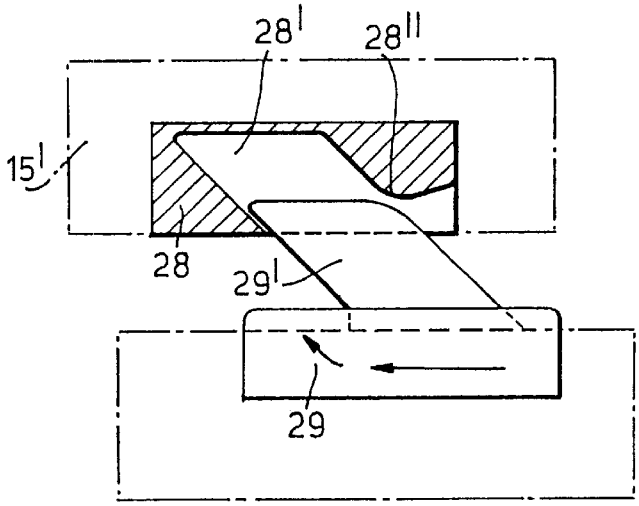
FIG. 33 illustrates operation of the safety fitting.
Figure 34:
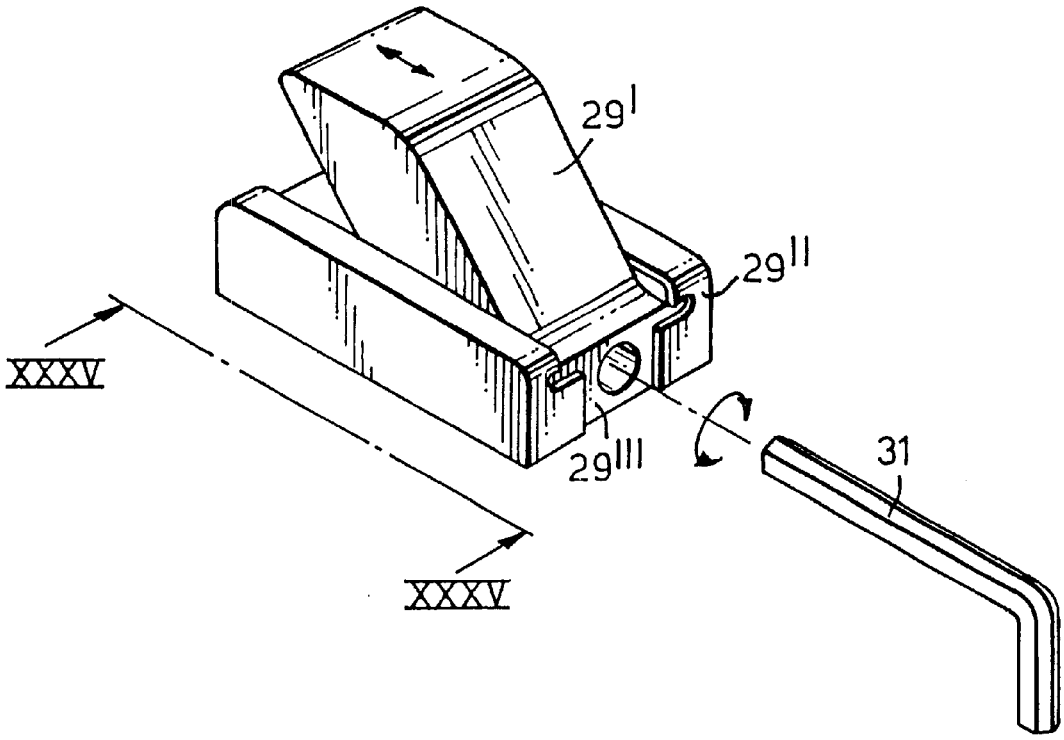
FIG. 34 is a perspective view of a male part of the safety fitting.
Figure 35:
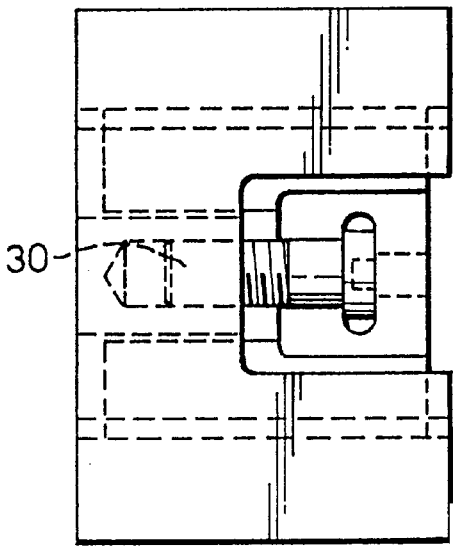
FIG. 35 is view XXXV—XXXV indicated in FIG. 34.

As shown in FIG. 4, there is a stationary panel 15 and a movable sliding panel 16 which can be moved along the rebate on carrying wheel 25 which runs along a guide rail 26 provided in the sill member 19. A lock and optionally an espagnolette mechanism 27 may be fitted in the end stile 16' of the sliding panel 16 which is to face towards the jamb 21 of the frame structure. To obtain an efficient seal between the rebate 24 and the weather strip 23, it is also important that the stile 16' is drawn towards the stile 15' and secured there. For this purpose, the use of a safety fitting is proposed which is intended to function as a rear edge fitting for the sliding panel. This safety fitting consists of a female part 28 which is intended to interact with a male part 29. To facilitate the understanding of the interaction between the female part and the male part, reference is made to FIGS. 32–35. The female part 28 is made with a hole 28' which is oblique relative to the mouth of the hole. The mouth forms an angle with the plane of the panel 15. A portion 28" around the mouth of the female part is rounded and somewhat indented relative to the other portions around the mouth. This means that the rounded portion 28" is closer to the bottom of the hole 28' than the other portions at the mouth. In the illustrated embodiment, the female part is secured to the stile 15' of the stationary panel 15. The male part 29 is made having an oblique, projecting pin 29' which forms an angle with the plane of the sliding panel 16 and extends in the direction of the stile 16' on the sliding panel 16. During longitudinal and simultaneous lateral movement of the sliding panel 16, the pin 29' will engage or disengage with said hole 28' in the female part 28. The male part 29 is preferably mounted on the stile 16' of the movable panel 16. If an embodiment with two movable panels were used, the female part 28 could, for instance, be arranged on the sliding panel 6, whilst the male part 29 could be arranged on the sliding panel 7. As shown in FIGS. 32, 34 and 35, the projecting pin 29' of the male part may be made adjustable in the direction of movement of the sliding panel. To this end, the male part may be bipartite with a retention piece 29' and a sliding piece 29'''. The male part can be provided with an adjusting screw 30 which can be operated with the aid of an Allen key 31.

By affixing the weather strip 23 as shown in FIG. 4, it is made difficult for water to enter the space between the stiles 15' and 16' and penetrate further into the space between these stiles. If the weather strip 23 had been placed further to the right on the figure, water would easily have remained in the space between the stiles 15' and 16'. It is also important that on the stile 15' there is a contact portion 24 or rebate parallel to the direction of movement of the sliding door, thus ensuring that a best possible sealing area is obtained.

In the solution shown in FIG. 3, the sliding panel 16 is supported on carrying wheels 25. However, it is important to ensure an efficient and desired control of the movement of the sliding panel 16, and for this purpose there is also provided a guide rail 32 in the head member 20.

The guide rail 32 has tracks designed for guiding a guide castor 33. In a similar manner, the rail 26 also has a track 26' intended for a guide castor 34 which extends downwards from the underside of the sliding panel 16.

Figure 6:
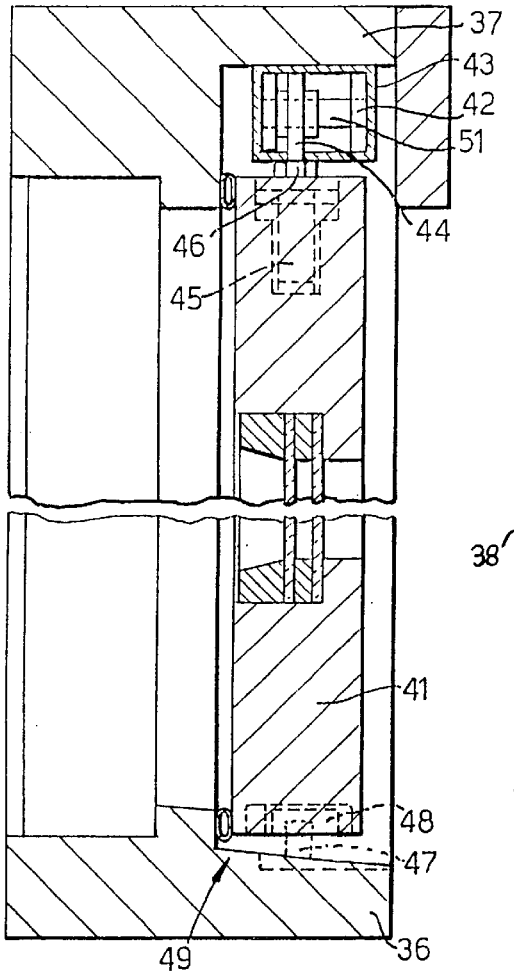
FIG. 6 shows the section VI—VI in FIG. 5.
Figure 5:
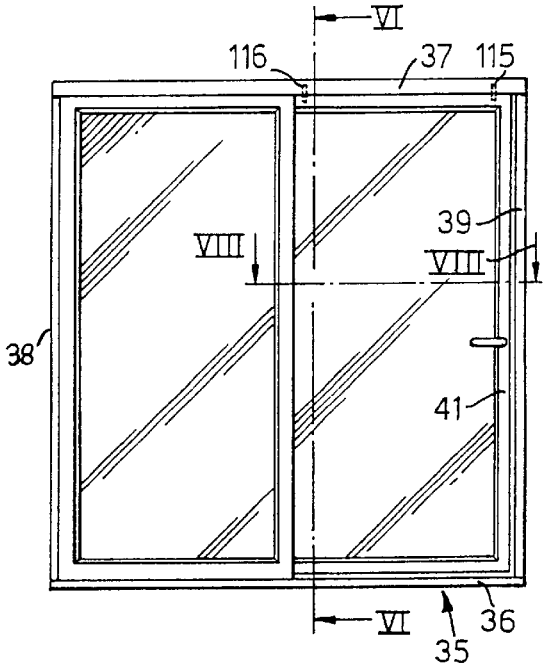
FIG. 5 shows a sliding panel that is movable in a frame structure relative to a fixed element.
Figure 42:
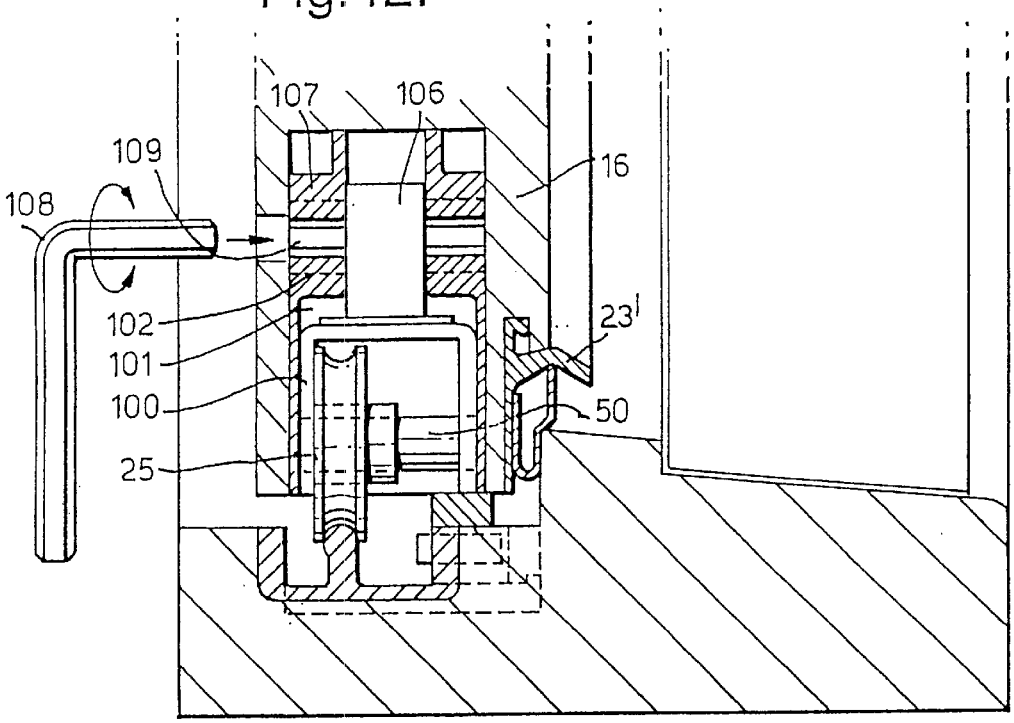
FIG. 42 shows a partially cutaway vertical projection of the height-adjustable carrying wheel.
Figure 43:
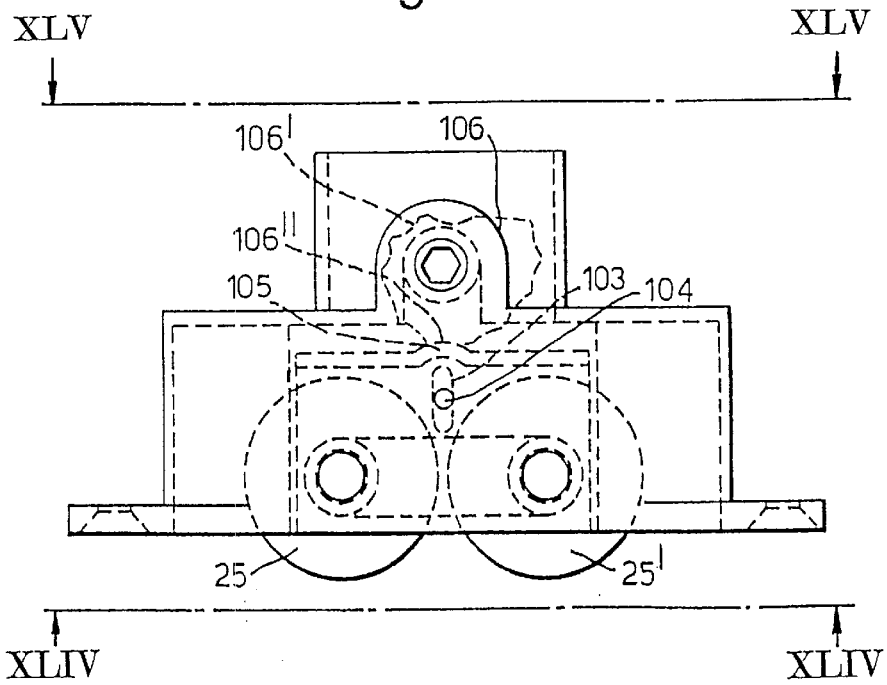
FIG. 43 shows the carrying wheel in a bogie assembly with height adjustable supporting axle.
Figure 44:
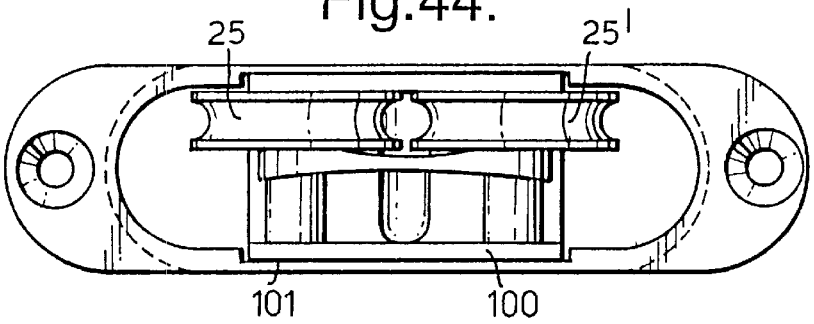
FIG. 44 shows a bottom view XLIV—XLIV of the bogie assembly of FIG. 43.
Figure 45:
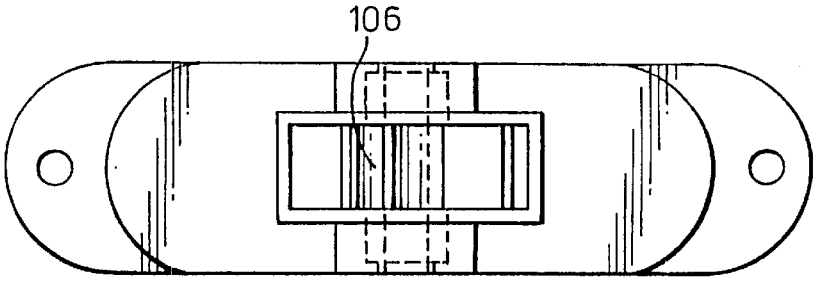
FIG. 45 is view XLV—XLV in FIG. 43.

In FIGS. 5–8 a sliding panel construction is shown having frame 35 including a sill member 36, head member 37 and jambs 38, 39. In the illustrated embodiment there is a stationary panel 40 fixedly mounted to the frame structure 35 and a movable sliding panel 41. In relation to the construction shown and described in connection with FIGS. 2–4, the embodiment according to FIGS. 5–8 differs from that in FIGS. 2–4 in that the sliding panel 41 has carrying wheels 42, 42' made in the form of suspension wheels which run in a rail 43 mounted in the head member 37. The suspension wheels 42, 42' form a pivotal connection with a suspension fitting 44, 44', respectively which is secured via a screw connection 45 in the top edge of the sliding panel 41. An adjusting nut 46 and the screw connection 45 permit adjustment of the sliding panel 41 relative to the frame structure 35. As shown at the bottom of FIG. 6, the sill member of the door frame may have a guide pin 47 which engages with a guide rail 48 in the bottom of the sliding panel 41. As can be seen clearly from FIG. 6, this embodiment involves a solution where the sliding panel 41 slides along an outer rebate 49, instead of along an inner rebate, as indicated in FIG. 3. For this reason, it may be advantageous to place the guide track 48 on the underside of the sliding panel instead of in the sill member 36 in order thereby to avoid the guide track becoming filled with contaminants, e.g., water which freezes and turns into ice, sand or another obstacles which prevent free movement of a wheel in a rail of this kind. As with the embodiment in FIG. 3 (see also FIG. 42), where the carrying wheel 25 is laterally movable along an axle 50, it will also be necessary in the case of the embodiment in FIG. 6, where the carrying wheels are provided on the upper side of the sliding panel, to allow the suspension fitting 44 to be laterally movable relative to the axle 51 of the suspension wheels 42. Without said sideways movability, it would not be possible to undertake a sideways movement of the sliding panel by using guide castors/guide tracks or guide pins/guide tracks. In the embodiment that can be seen from FIG. 8, the safety fitting 28, 29 is mounted the other way around, i.e., that the female part 28 is fixedly mounted in the sliding panel with its oblique hole 28' facing in the direction of movement of the sliding panel towards the jamb 39. The male part 29 is fixedly mounted in the panel 40 with the projecting pin 29' facing away from the jamb 39. This manner of mounting shown in FIG. 8, which is the reverse of that shown in FIG. 4 and also FIGS. 32, 33, is due solely to the consideration of a simple adjustment facility for the male part 29, whilst the adjustment facility of the safety fitting will not be accessible other than from the inside of the sliding panel construction.

Figure 8:
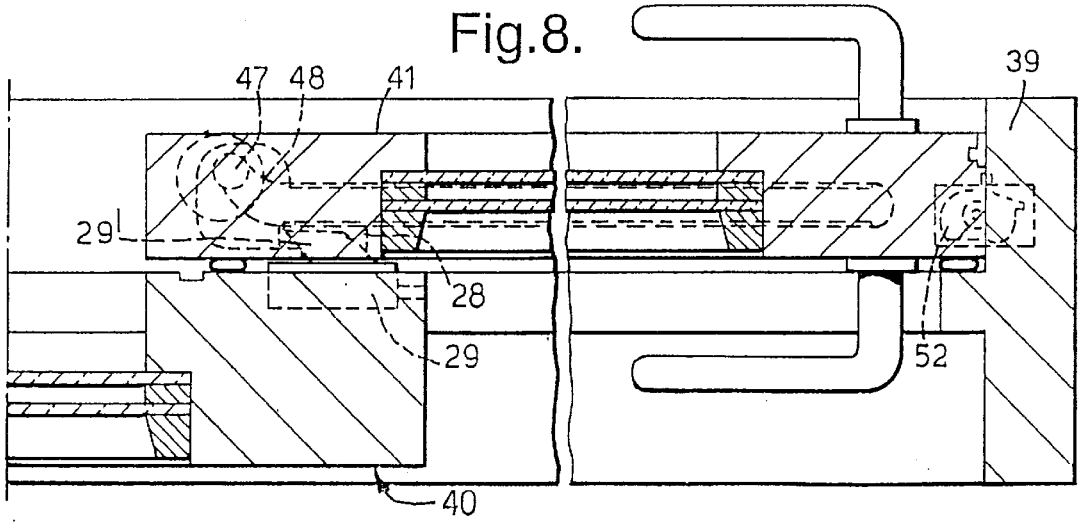
FIG. 8 shows the section VIII—VIII in FIG. 5.
Figure 38:
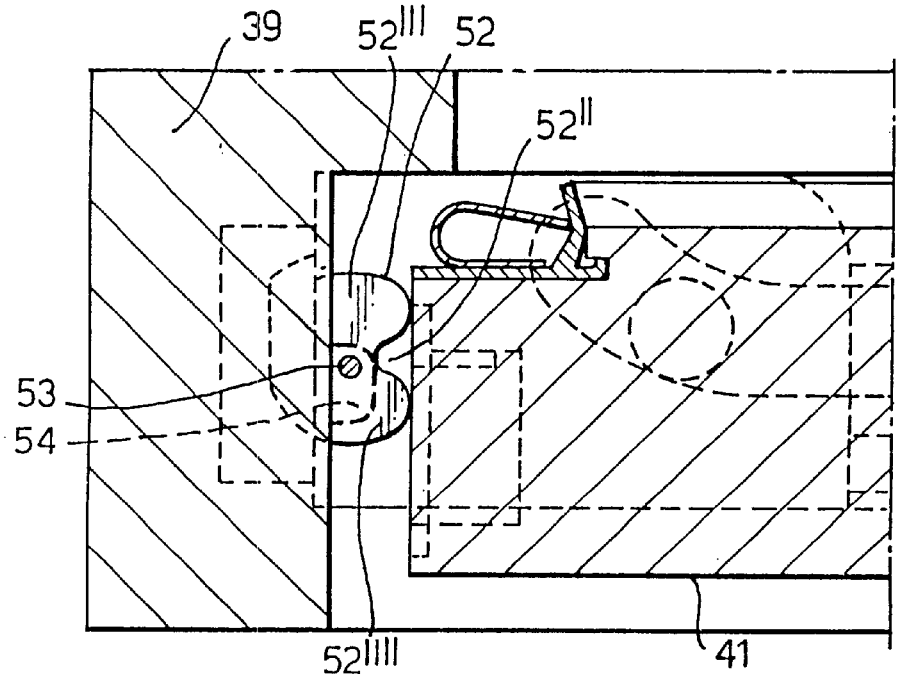
FIG. 38 shows a turning piece for guiding of the sliding panel transverse to the frame structure, when the sliding panel is a short distance from a vertical portion of the frame structure.
Figure 39:
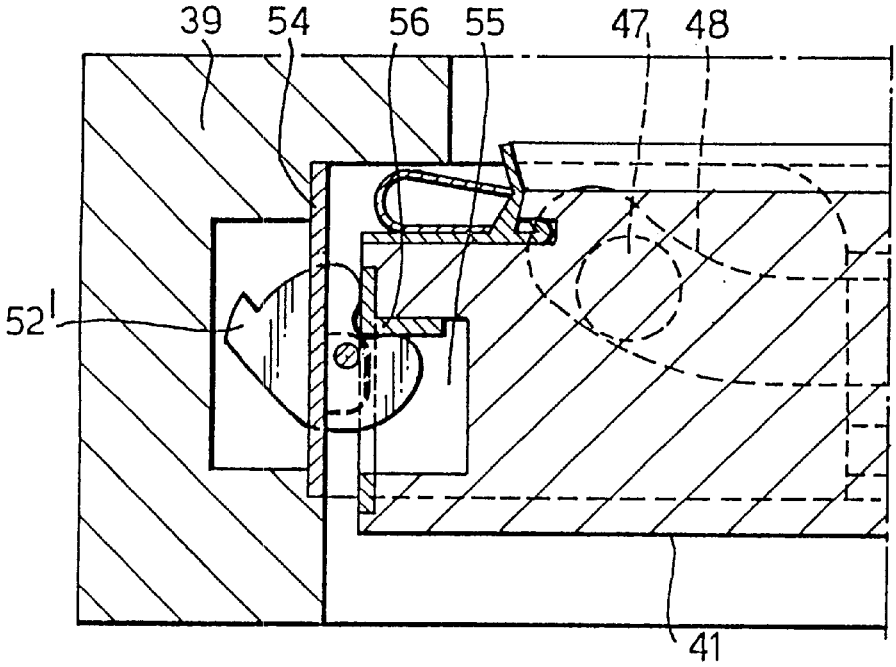
FIG. 39 shows a structure as shown in FIG. 38, with the sliding panel closer to said vertical portion of the frame structure and with transverse guiding of the panel commenced.
Figure 40:
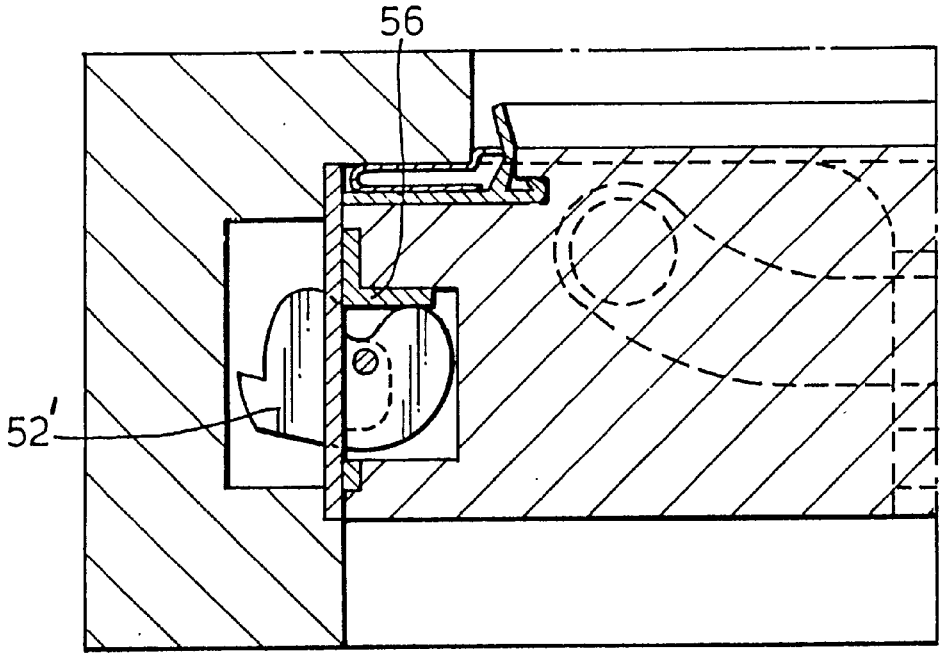
FIG. 40 shows the sliding panel in contact with the vertical portion of the frame structure and the turning piece in its locking end position.
Figure 41:
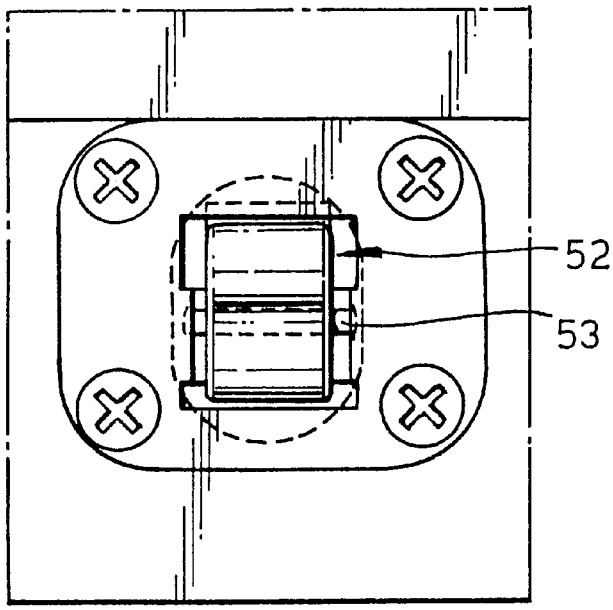
FIG. 41 is an elevation of the turning piece as disclosed in FIGS. 38–40.

If FIG. 8 is studied, it will be appreciated that when the sliding panel 41 is pushed towards the left, the guide track 48 which at its end portion is curved, will follow the guide pin 47 and thus move the panel 41 sideways at the same time as it moves in a longitudinal direction. Thus, the female part 28 will run clear of the male part 29 so that the sliding panel 41 can be moved freely in the frame structure 35. A similar guide track 48 may of course be provided at a portion of the head member and sill member closest to the jamb 39. Further, the top and bottom of the sliding panel 41 which is closest to the jamb 39 may have a guide pin 47. In the case illustrated here, only one guide track 48 and one guide pin are used. This is made possible through the use of a turning piece 52 for guiding the panel 41 into sealing contact against the jamb 39. This function will now be described in more detail in connection with FIGS. 38–41. The turning piece 52 is shown mounted in a depression in the jamb 39, and apart from a stop cam 52' it is essentially kidney-shaped, seen in horizontal section. Close to the bottom of its indentation 52", the turning piece 52 is pivotally mounted via a spindle 53 in a bracket 54 on the guide fitting. The turning piece 52 is partly pivotal into the jamb 39. The sliding panel 41 is provided with a recess 55 in a stile portion which faces towards the jamb 39 and is also provided with a striking plate fitting 56, with which the turning piece 52 is to engage. When a first portion 52''' engages with the striking plate 55, the turning piece 52 will begin to turn counter-clockwise as seen in FIGS. 38–40. A second portion 52'''' will thus begin to move into the recess 55 and come to bear against a portion of the striking plate 56 located in the longitudinal direction of the sliding panel. Consequently, when the sliding panel 41 is pushed more to the left, as seen in FIGS. 38 and 39, the turning piece 52 will turn more and more counter-clockwise and the portion 52'''' of the turning piece 52 will force the sliding panel to move transverse to its longitudinal direction of movement. Through the use of guide pin 47 and guide track 48, there is produced simultaneously a controlled movement of the sliding panel in the final phase of the transverse movement. When the turning piece 52 is in the position which is evident from FIG. 40, it has come into a locking position. A sliding movement transverse to the longitudinal direction of the sliding panel will be counteracted by the position of the turning piece relative to the striking plate 56.

Figure 7:
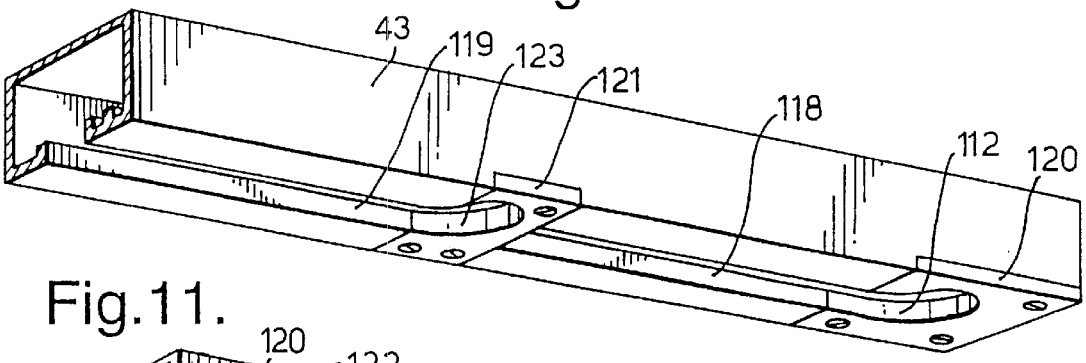
FIG. 7 shows an overhead rail with guide track for use with the embodiment in FIG. 6.
Figure 11:
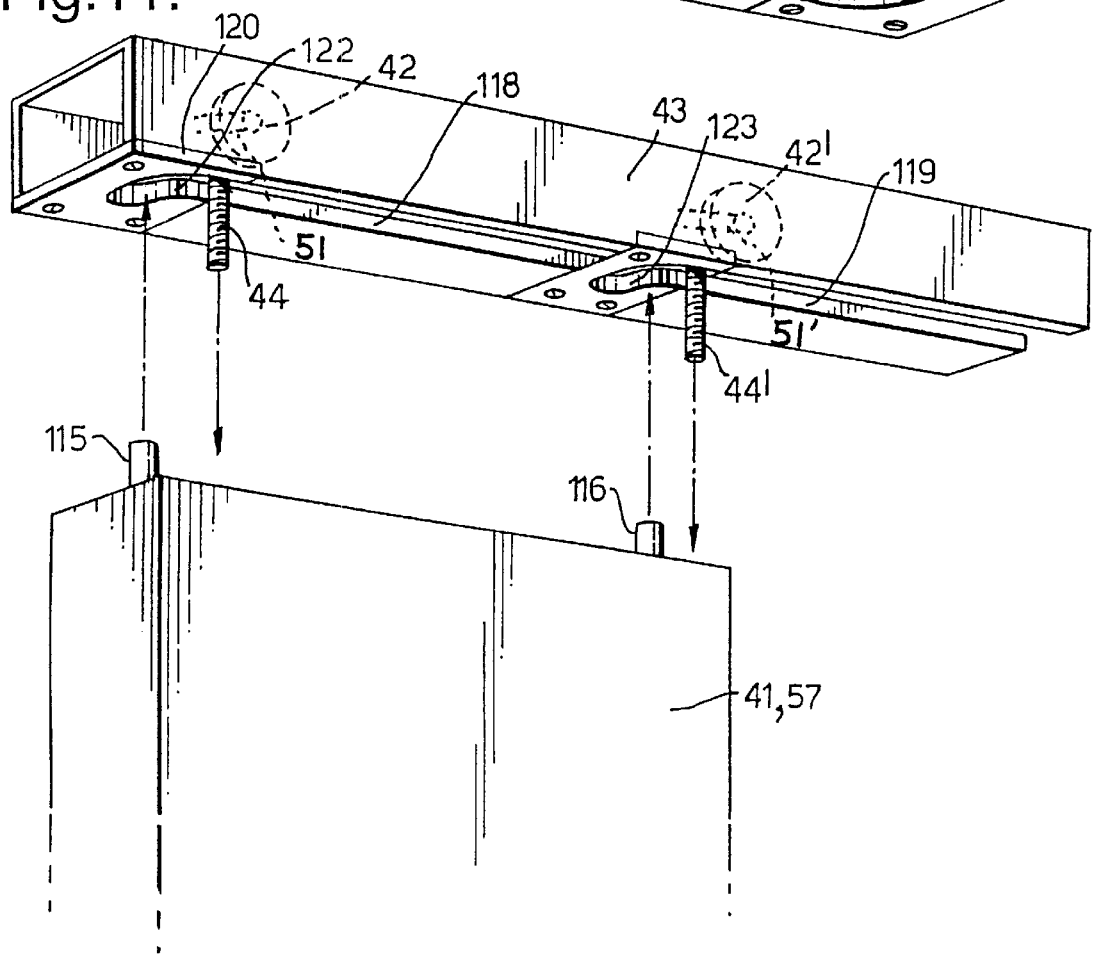
FIG. 11 shows the overhead rail in FIG. 10 with guide track and with guide pins or castors indicated together with suspension wheels.

In the solution shown in FIGS. 9–12, the sliding panel is indicated by means of the reference numeral 57, whilst the stationary panel is indicated by means of the reference numeral 58. As shown and described in connection with FIG. 12, in this case too, the bottom face of the sliding panel 57 will be provided with two guide tracks 48 and 48' which, by engaging with two guide pins 47, 47', will provide a movement transverse to the longitudinal direction of movement of the sliding panel for sealing contact with the frame structure 60, i.e., with the sill member 61, head member 62 and jamb 63 thereof and also with the stile portion 58' of the stationary panel 58 which has a sealing rebate portion 64. The weather strip 23 of the sliding panel will also come to bear against the rebate portion 65 of the frame structure. Here, it will be seen that the pin 47 which is closest to the jamb 63 is designed to engage only with the curved guide track 48', whilst the pin 47' is intended to engage with both the straight and the curved portion of the guide track 48.

Where an overhead rail 43 is employed, e.g., as is shown in FIGS. 6, 7, and 10, it will also be necessary to secure the movements of the sliding panel 41; 57 at a top region thereof. For this purpose, the overhead rail 43 is equipped with guide tracks 118, 119 which extend the length of the rail on the underside thereof. To bring the sliding panel 41; 57 in towards the frame structure in a locking position, portions are milled out in the underside of the rail 43 for securing guide plates 120, 121 having curved guide tracks 122, 123. As shown in FIG. 11, on the upper side of the panel 41; 57 there are provided guide pins—or castors 115, 116 which extend upwards into sliding engagement with respective tracks 118, 122 and 119, 123. For sake of clarity on FIG. 11, only one carrying wheel 42, 42' is shown with part of its associated axle 51, 51'.

Figure 13:
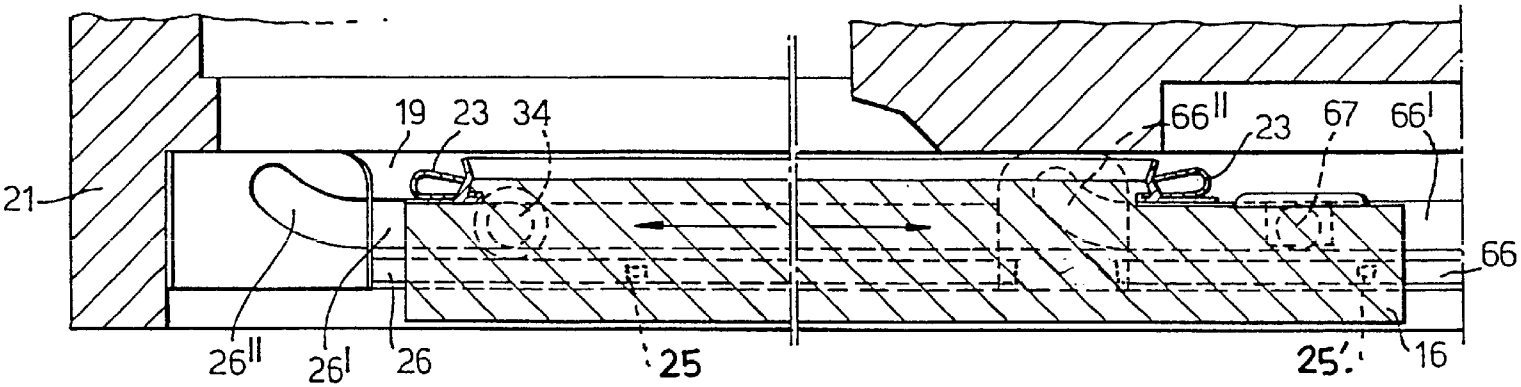
FIGS. 13, 14 and 15 show a lower section of a sliding panel during movement in a longitudinal direction in the frame structure in a non-closed position and a partially closed position and a closed position, respectively.
Figure 14:
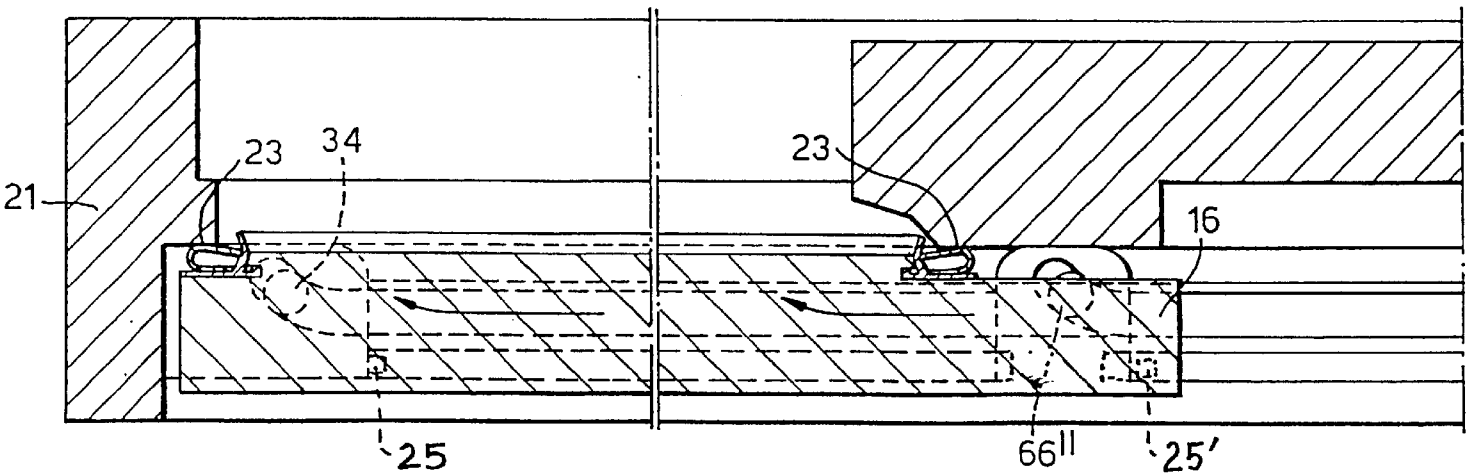
Figure 15:
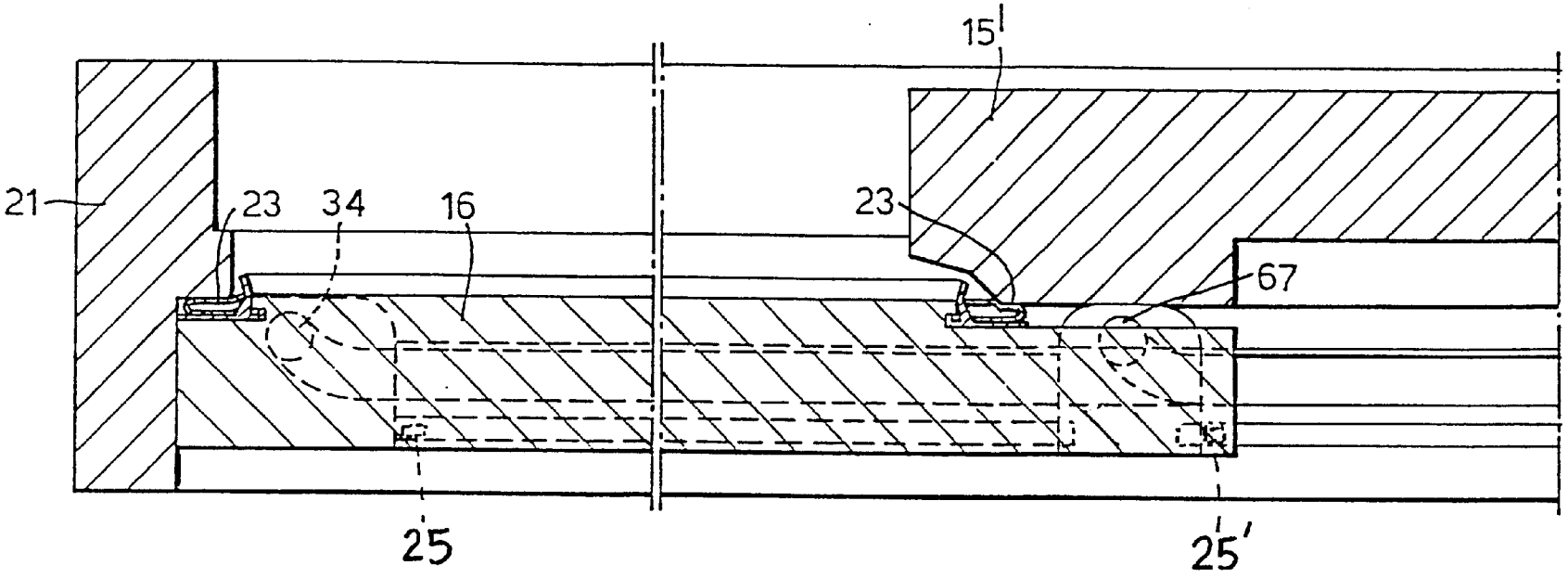
Figure 16:
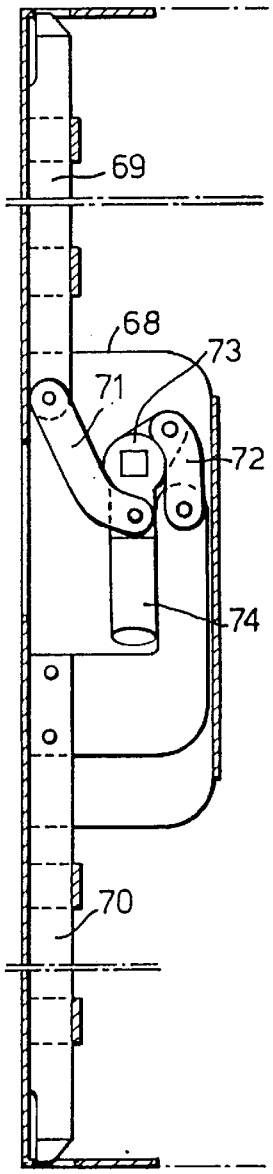
FIG. 16 shows a lock case with an espagnolette fitting which forms a part of the locking device according to the invention.
Figure 17:
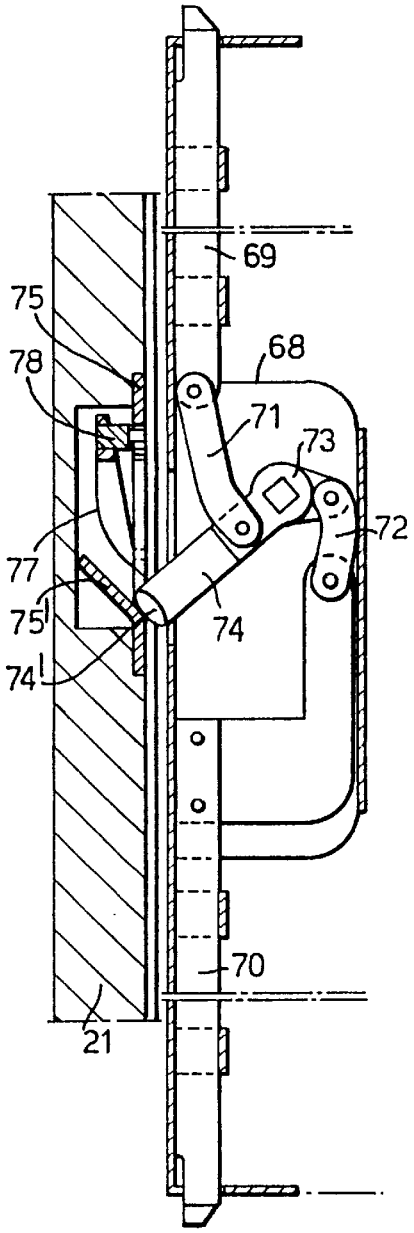
FIG. 17 shows the lock case in interaction with a striking plate.
Figure 18:
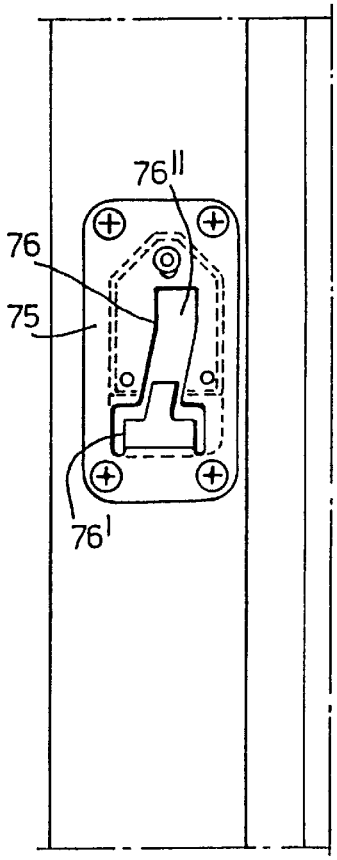
FIG. 18 is an elevation of the striking plate in FIG. 17.

FIGS. 13–15 will now be explained in more detail in association with what has been taught and described in connection with the embodiment in FIGS. 2–4. A person versed in the art will understand immediately that the embodiments in FIGS. 5–8 and 9–12 represent technical equivalents of that shown in FIGS. 2–4 and 13–15. FIGS. 13–15 are also related to the section IV—IV in FIG. 2 which corresponds to FIG. 4.

Although FIGS. 13–15 will only be explained in connection with the guiding associated with the guide track 26' and the guide castor 34, it will however be appreciated that corresponding means are also found at the upper side of the sliding panel, represented by the guide track 32 and the guide castor 33, see FIG. 3. The solution is also applicable when using overhead rail 43, guide tracks 118, 119 and with interacting guide pins 115, 116 at the upper side of the sliding panel.

Figure 36:
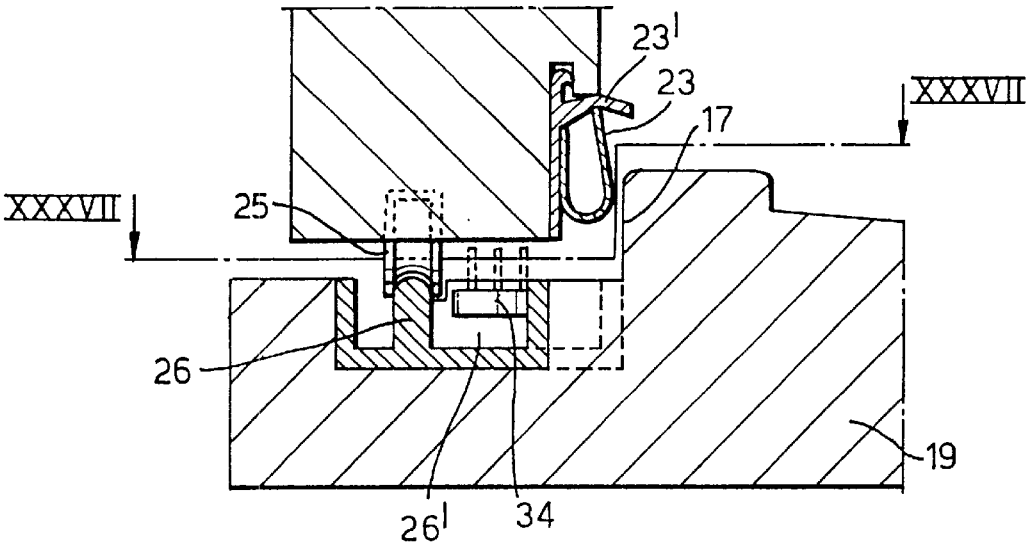
FIG. 36 shows a cross-section through a lower portion of a sliding panel and adjacent sill member in the frame structure.
Figure 37:
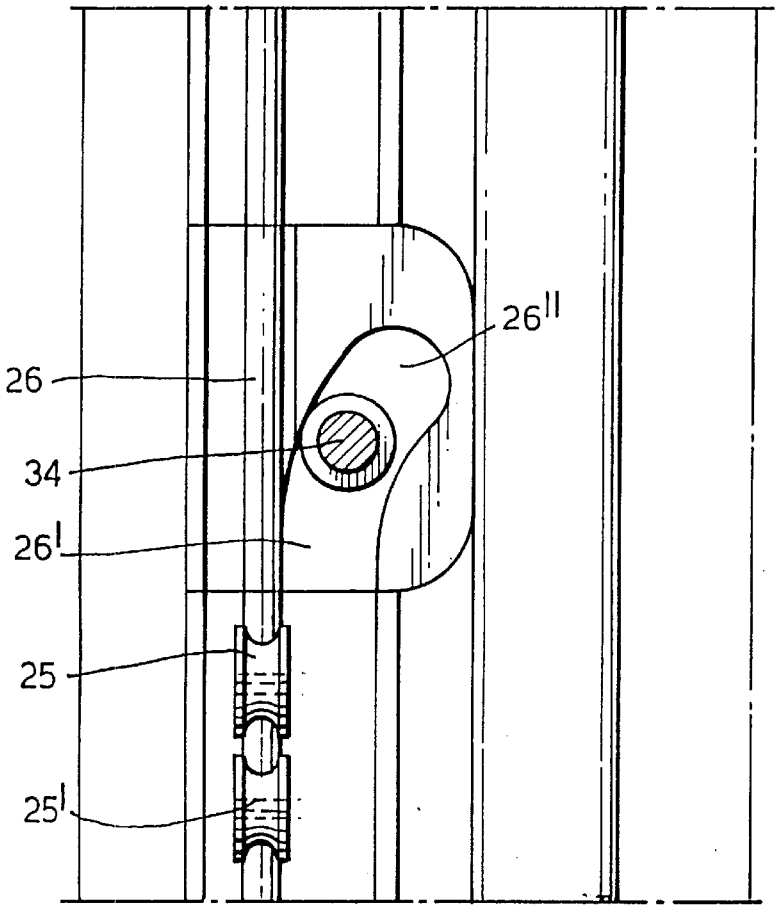
FIG. 37 shows the section XXXVII—XXXVII in FIG. 36.

The sill member 19 has two separate pairs of rail body parts 26, 26' and 66, 66' positioned one after the other along its entire length in the longitudinal direction, as indicated in FIG. 13. The rail body parts 26 and 66 serve as a support for panel carrying wheels 25, 25', whilst the rail body parts 26', 66' serve as a guide track for guide castors 34 and 67, respectively. At each end portion of the guide track 26'; 66' that is closest to the jamb 21, there is provided a curved, final guide track portion 26"; 66". When the sliding panel 16 is pushed to the left, as shown in FIGS. 13 and 14, the guide castors 34 and 67 will gradually pass from the straight portion of the guide tracks 26', 66' to the curved portions 26", 66", whereby the sliding pane 16 will move transversely at the same time as it is pushed in the longitudinal direction, so that ultimately it bears against the jamb 21, as shown in FIG. 15. In this position, the weather strips 23 will come into sealing contact with the sill member 19, jamb 21 and head member 20 of the frame structure 18, and also the stile 15' of the stationary panel. By virtue of the fact that the carrying wheel 25 is at the same time movable on its axle 50, as shown and described in connection with FIG. 42, a composite movement of the sliding panel is obtained which makes possible an easily movable sliding panel that provides good sealing. For further details, reference is made to FIGS. 36 and 37 among the figures in this description. As indicated in connection with FIGS. 1 and 2, it will be desirable to be able to provide a locking device for a sliding panel. It will also be expedient to allow such a locking device to interact with an espagnolette mechanism.

For a more detailed explanation in connection with the locking device, reference will be made to FIGS. 16–22. The lock case is indicated by means of the reference numeral 68 and preferably has an espagnolette mechanism connected thereto, although this is not an absolute condition. The espagnolette mechanism has vertically movable bolts 69 and 70 which via articulations 71 and 72 form a connection with a rotating mechanism 73 in the lock case 68. The rotating mechanism 73 has a dead bolt 74 that is rotatable thereto in the vertical plane. The bolt 74 is designed to engage with a striking plate 75 which is preferably fixed to a jamb, such as the jamb 21. The dead bolt 74 is initially designed for a turning movement through an angle of about 90° and outermost is made having a thickened portion 74'. The striking plate 75 has an insertion opening 76 which has a first portion 76' of a first width which merges into a second portion 76". The second portion is oblique along essentially its entire length, and has another, smaller width which is greater than the thickness of the dead bolt 74, but smaller than the width of the thickened portion 74' of the bolt 74. On the back of its front portion, the striking plate 75 has a curved contact portion 77. The inclination of this curved contact portion may optionally be adjustable with the aid of an adjusting screw 78. The contact portion 77 with its backward facing side is to serve to engage with the thickened portion 74' of the dead bolt 74, so that when the bolt 74 is in abutment with the contact portion 77, it will not be capable of being drawn out of the striking plate 75 owing to the thickened portion 74', provided the bolt is not turned down into the position shown in FIG. 17. The contact portion 77 thus extends in a direction along the second portion 76" of the insertion opening.

Figure 21:
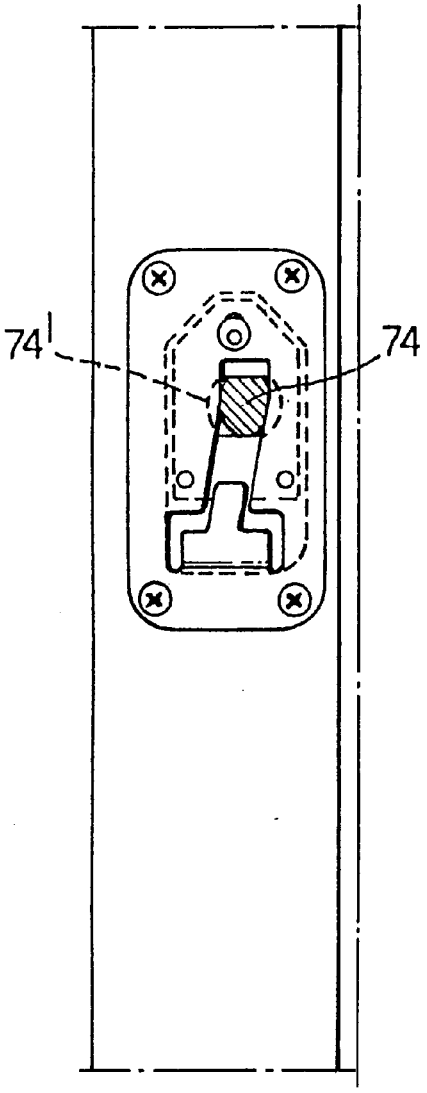
FIG. 21 is a view along the line XXI—XXI in FIG. 20.
Figure 22:
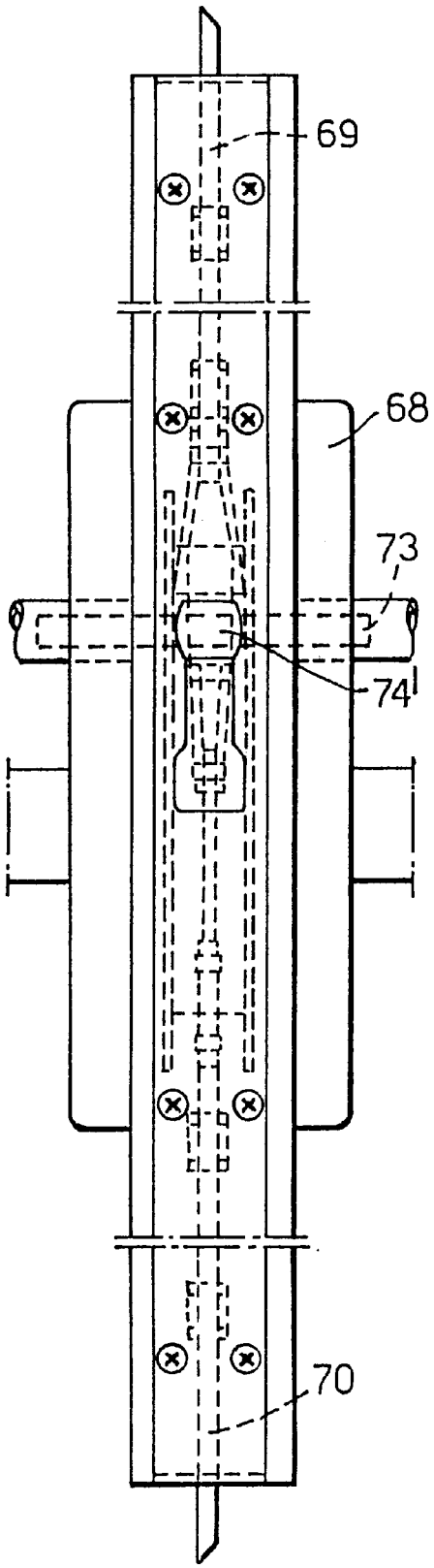
FIG. 22 is an end view of the lock case with espagnolette mechanism as indicated by arrows XXII—XXII in FIG. 19.

At the first portion 76' of the insertion opening 76, the striking plate 75 has an oblique slide plate 75'. This slide plate 75' provides a sliding face for the thickened portion 74' of the dead bolt 74 when it is moved into or out of the striking plate. However, when the bolt 74 is moved down and out of the striking plate 75, the slide plate 75' will help to push the sliding panel a little away from the jamb 21 to draw the sliding panel out of sealing engagement with the frame structure. Similarly, during the movement of the dead bolt 74 into the striking plate 75 and into engagement therewith, the sliding panel 16 will be guided both in the longitudinal direction of the sliding panel! in that the thickened portion 74' of the dead bolt 74 will come to bear against the contact portion 77 in the striking plate 75, at the same time as the second portion 76" of the insertion opening is oblique along essentially its entire length. In FIG. 21 it will be seen that the thickened portion of the bolt 74 will remain at the back of the second part of the insertion opening 76 and also behind the contact portion 77. By manipulating the adjusting screw 78, it will be possible to change the inclination of the contact portion 77, which may be a useful aid to the fine adjustment of the engagement of the bolt with the striking plate 75.

Figure 19:
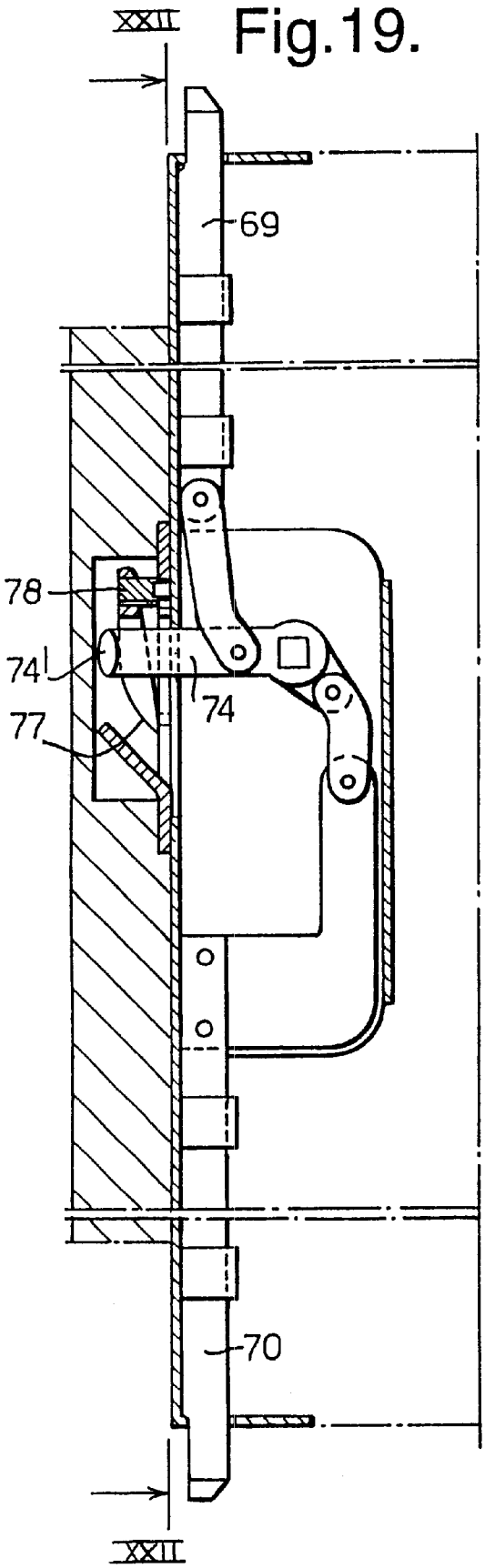
FIG. 19 shows the locking device in FIGS. 16 and 17 in engagement with the striking plate.
Figure 20:
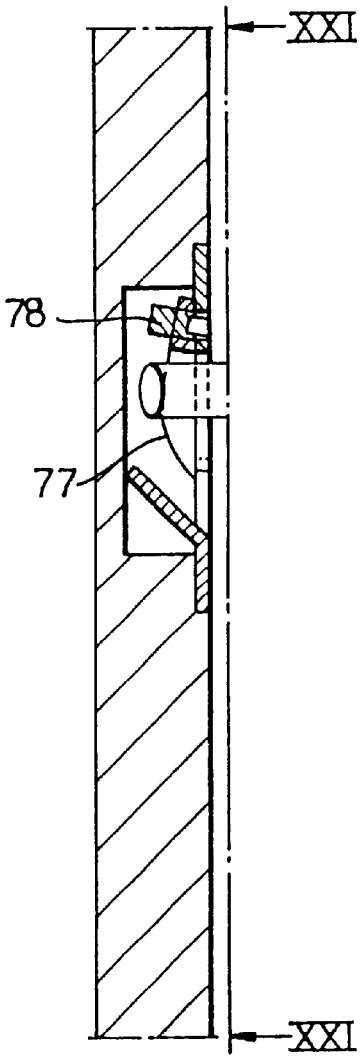
FIG. 20 illustrates adjustability of the striking plate relative to the locking device dead bolt.

FIGS. 19 and 20 show how the dead bolt 74 with its expanded portion 74' has come into full engagement with the striking plate 75 with the aid of its contact portion 77. FIG. 21 is an end view of the sliding panel with the locking device and possible espagnolette mechanism.

When the bolts 69, 70 of the espagnolette mechanism are to engage with striking plates in respectively the sill member and head member in a frame structure, it is important that they have a controlled movement into the striking plate. To this end, it is proposed, as shown in connection with FIGS.

23–26, to allow an end portion of the bolt, in this case bolt 70, to be chamfered. When the bolt is guided down into the opening 79 in the striking plate, it will be expedient to equip a striking plate 82 with journalled balls 80, 81. The position for these journalled balls could be made adjustable, since they are attached to the striking plate 82 by means of a threaded connection. The striking plate 82 may also contain the curved guide track 26". The striking plate 82 may be made adjustable in the longitudinal direction of the sliding panel by means of adjusting screws 83, 84 which extend through elongate adjusting grooves 85, 86 in the striking plate 82. The balls 80 and 81 are rotatable on their mounting 80', 81'.

Figure 23:
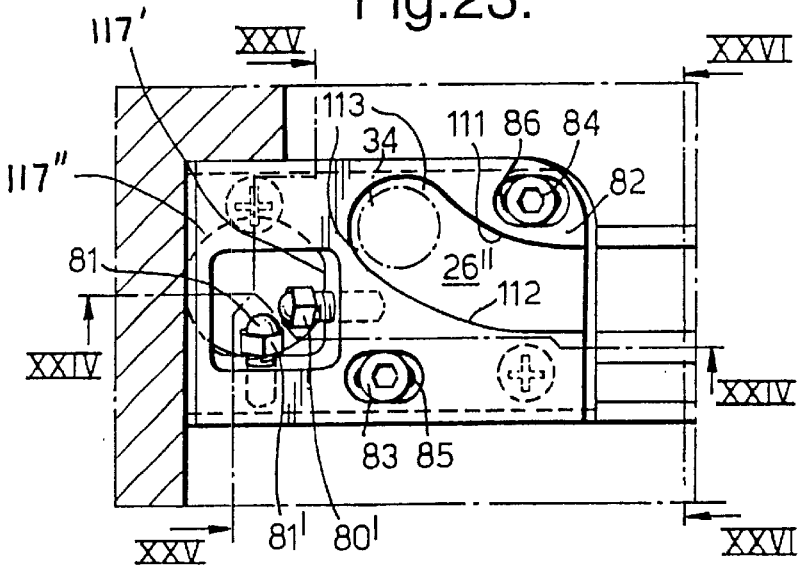
FIG. 23 shows a fitting which forms the striking plate for an espagnolette lock which is a constituent part of the locking device.
Figure 24:
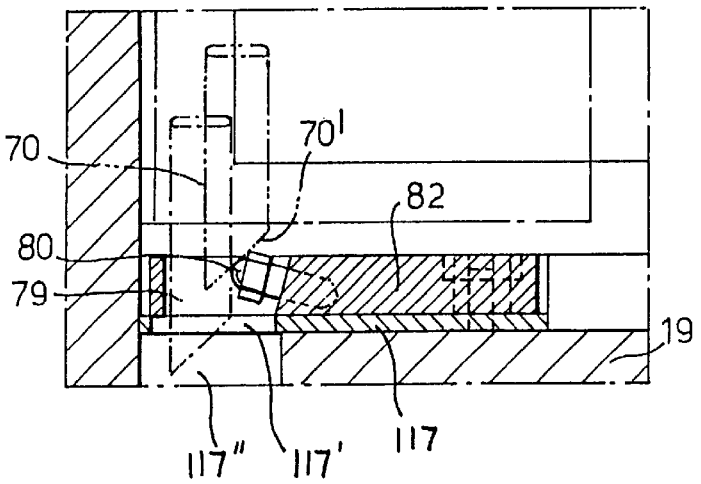
FIG. 24 shows the section XXIV—XXIV in FIG. 23.
Figure 25:
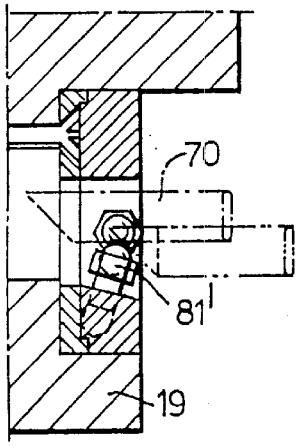
FIG. 25 shows the section XXV—XXV in FIG. 23.
Figure 26:
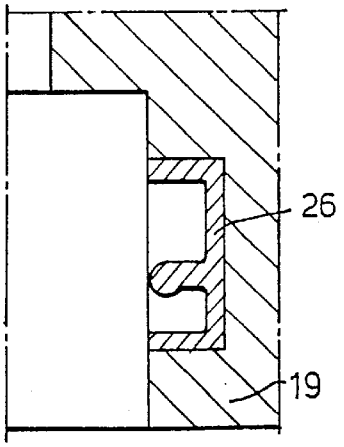
FIG. 26 shows the section XXVI—XXVI in FIG. 23.

As shown in FIG. 23, the guide track will have a first curved portion 111 and a second curved portion 112. When closing the sliding panel 16, the guide castor 34 will follow the curve 112 and thus force the sliding panel in against both the rebate and ultimately in position for the bolts of the espagnolette lock, such as the bolt 70. The curved portion 111 will function in a similar manner when the sliding panel is opened. When the bolts in the espagnolette lock, such as the bolt 70, slide down, the chamfered portion 70' at the bottom of the bolt 70 will slide against the two joumalled balls 80, 81 and thus also force the sliding panel into a movement at an angle of about 45° relative to the direction of movement of the sliding panel towards the rebate and rest in the frame. The curved portions 111 and 112 have a radius of curvature and design such that when the bolt, e.g., the bolt 70, and the balls 80, 81 take over the control of the direction of movement of the sliding panel, clearance 113 will arise between the guide castor 34 and the curved portions 111, 112 of the guide track 26", thereby ensuring that the guide rollers do not come under any strain of force between the closing and opening function, i.e., in the closed position of the sliding panel. 117' denotes a hole in base member 117 supporting the striking plate 82, and 117" denotes a hole in the sill 19 below hole 117'.

Figure 27:
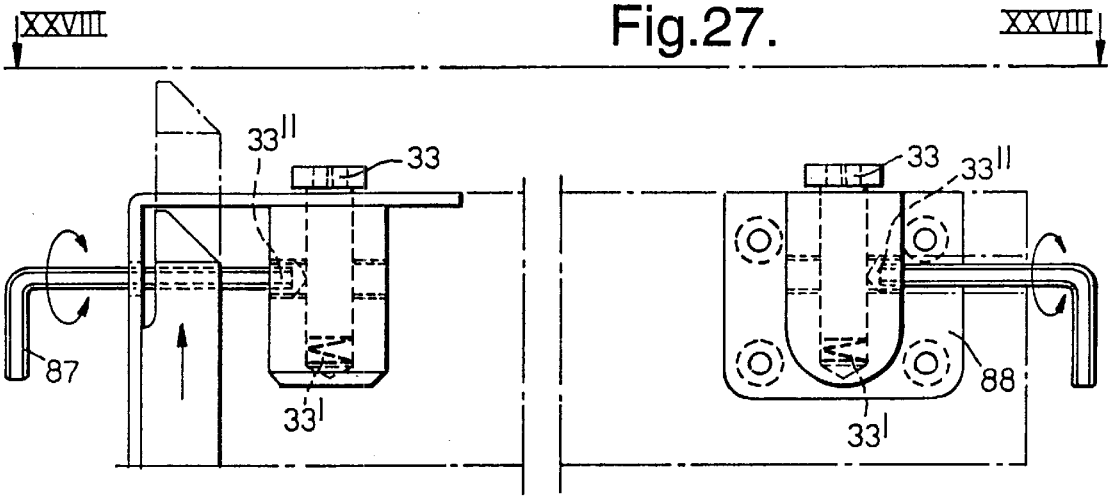
FIGS. 27 and 29 show the adjustment facility of the guide castors respectively at the top and the bottom of the sliding panel respectively.
Figure 28:
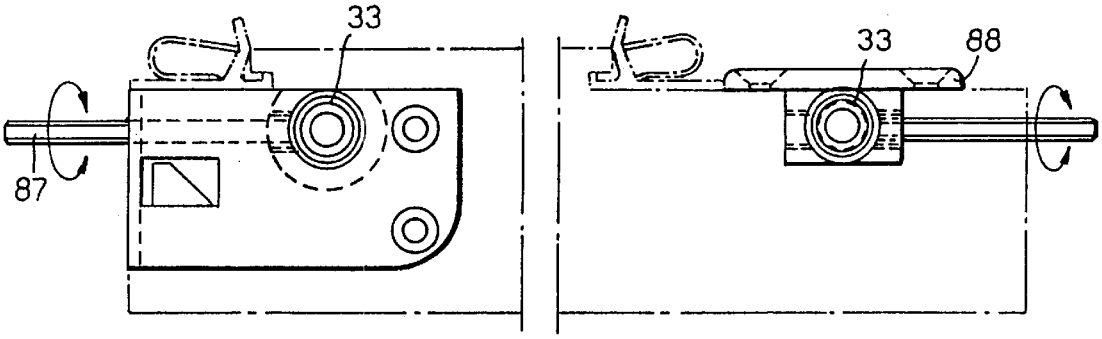
FIG. 28 shows a plan view of the sliding panel from above according to view XXVIII—XXVIII of FIG. 27.
Figure 29:
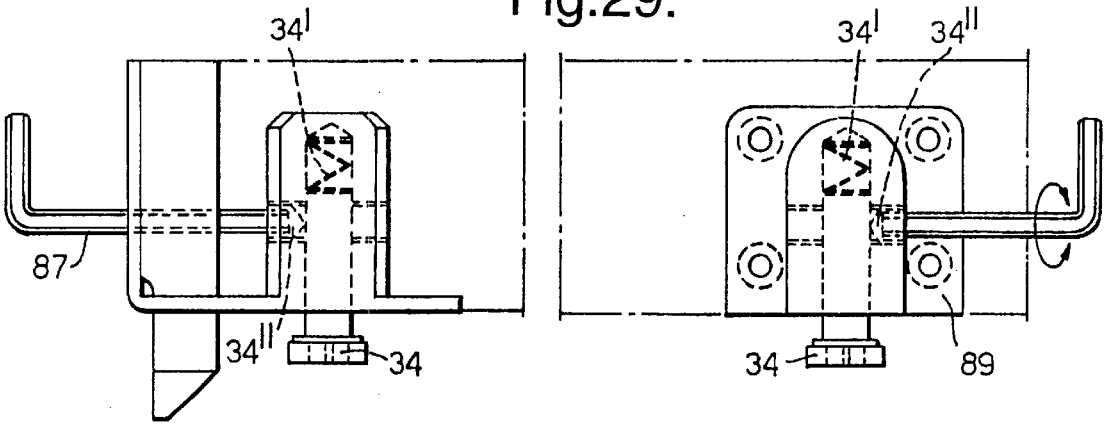

It will be necessary to be able to make vertical adjustments of the position of the guide castors which are to engage with the guide tracks, depending upon the distance of the sliding panel from respective guide tracks. In FIGS. 27–29 it is shown how this can be done in practice. On the left in FIGS. 27, 28 and 29 it is shown how the mounting for the guide castors 33, 34 can be integrated into the espagnolette fitting. The guide castors 33, 34 can be actuated by a spring 33' respectively 34'. A set screw 33", respectively 34", may be used to secure the guide castor 33, respectively 34, in the desired position. Loosening and tightening the set screw 33", 34" can be done with the aid of a tool, e.g., an Allen key 87. On the right in FIGS. 27, 28 and 29 an alternative mounting bracket for the guide castors 33 and 34 is shown. In this case, the mounting bracket is inserted from the side of the sliding panel and is for the sake of simplicity indicated by means of the reference numerals 88 and 89. These brackets may be identical per se.

Figure 30:
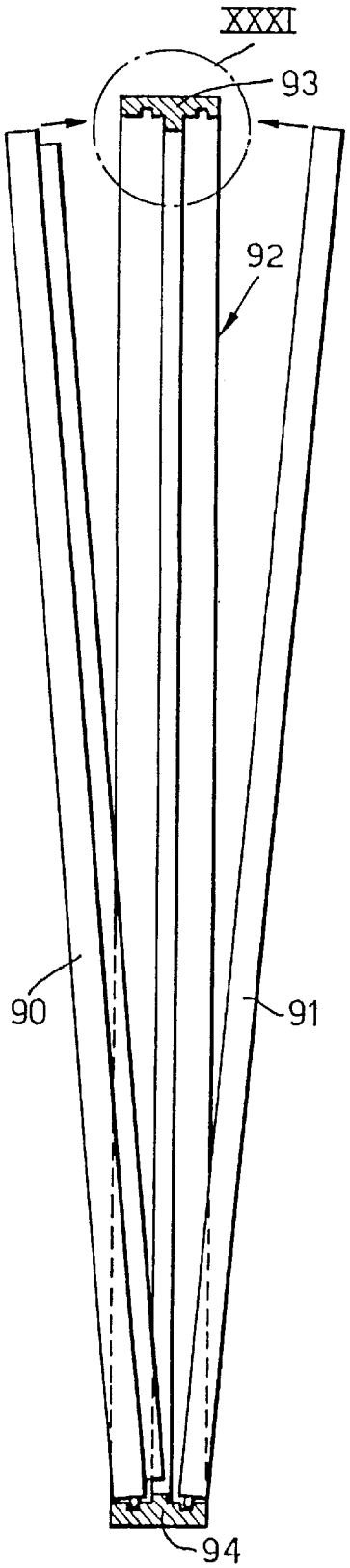
FIG. 30 illustrates the method of mounting the two movable sliding panels in a frame structure and FIG. 31 shows the sectional portion XXXI in FIG. 30 with the sliding panels in place.

In order to be able to swing a sliding panel 90 or 91 into place in a frame structure 92, which has a head member 93 and a sill member 94, it is important that the guide castors 33 can be lowered so that they run clear of the bottom side of the head member when they are swung into place, as is shown in FIG. 30. It will be understood immediately that in connection with a sliding door which faces towards the outside, it is important that it is not possible to gain access to the guide rollers and adjust them so that they disengage from the guide track. The adjustment of the vertical position of the guide castors could be carried out, e.g., from an end edge face of the sliding panel, as is shown in FIGS. 27–29, using a tool 87 which can operate a set screw 95.

Figure 31:
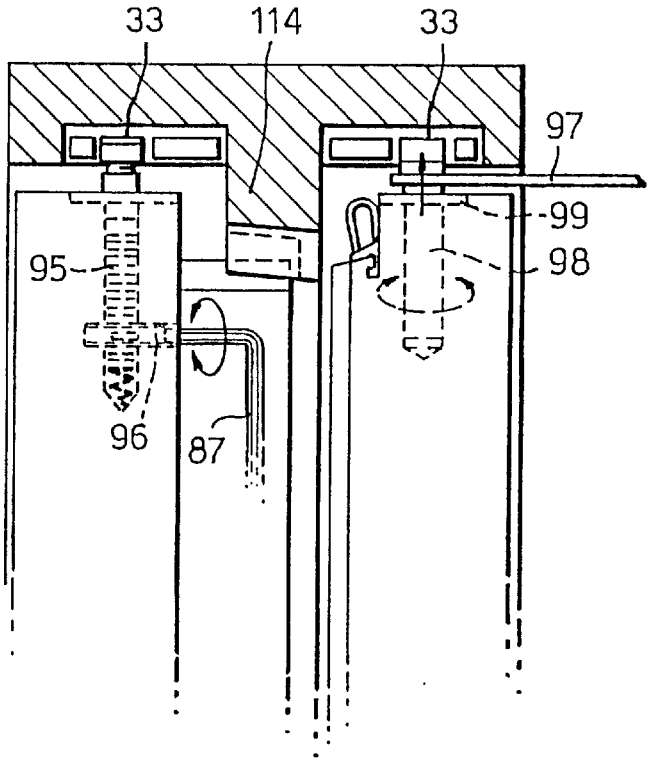

Further, as shown on FIG. 31, the guide castor 33 may conceivably be supported by a bar 95 made, at least along a lower portion, in the form of a toothed bar which can engage with an adjusting wheel 96 that is capable of being manipulated with the aid of a tool 87, e.g., an Allen key.

As a further alternative, there may be a hexagonal portion below the actual guide castor 33, which can engage with an Allen key 97, so that by turning the Allen key 97 the guide castor 33 can be raised or lowered, in that it is supported by a screw member 98 which forms threaded engagement with a holder 99 which is secured in the top edge of the sliding panel. However, it will be understood immediately that the solutions shown in FIG. 31 could equally well be secured from the side of the sliding panel as from the top.

Figure 46:
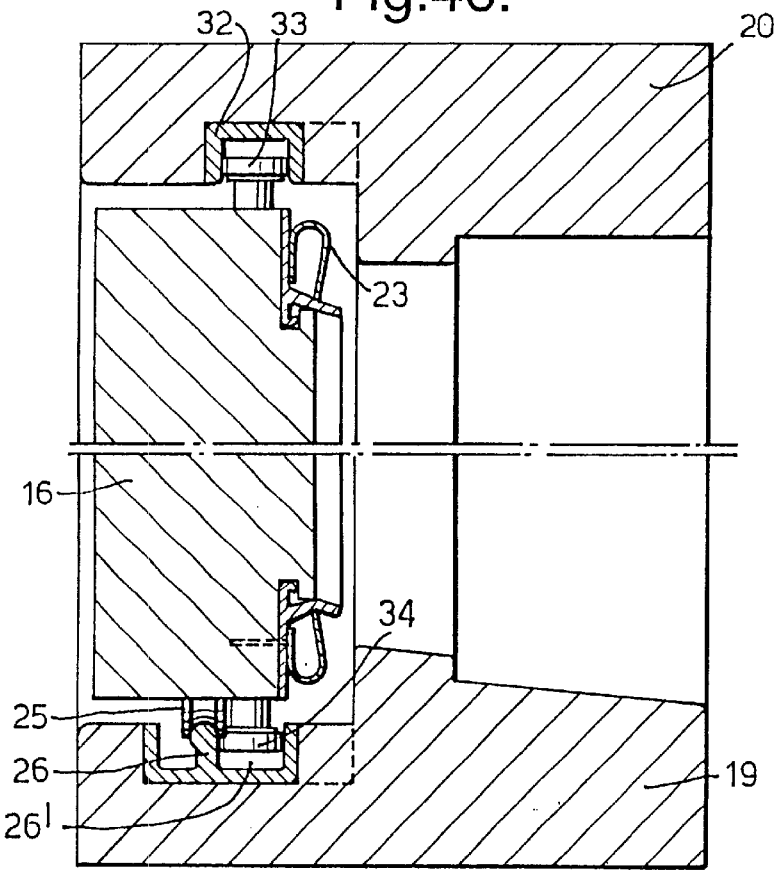
FIG. 46 is a vertical cross-section through a sliding panel in a frame structure, e.g., a sliding door in typical sliding position.
Figure 47:
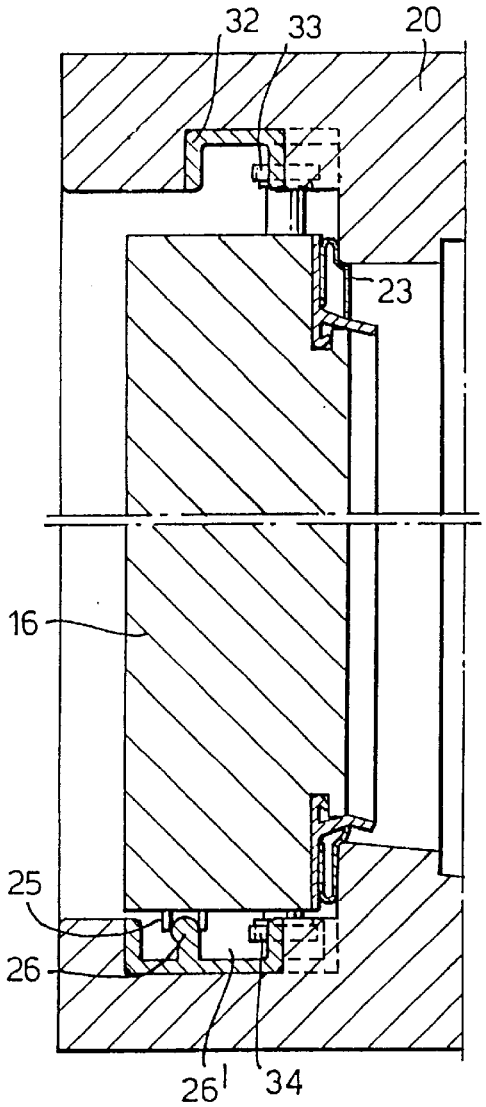
FIG. 47 shows the sliding panel of FIG. 46 adjusted to a maximum lower position relative to a frame structure.
Figure 48:
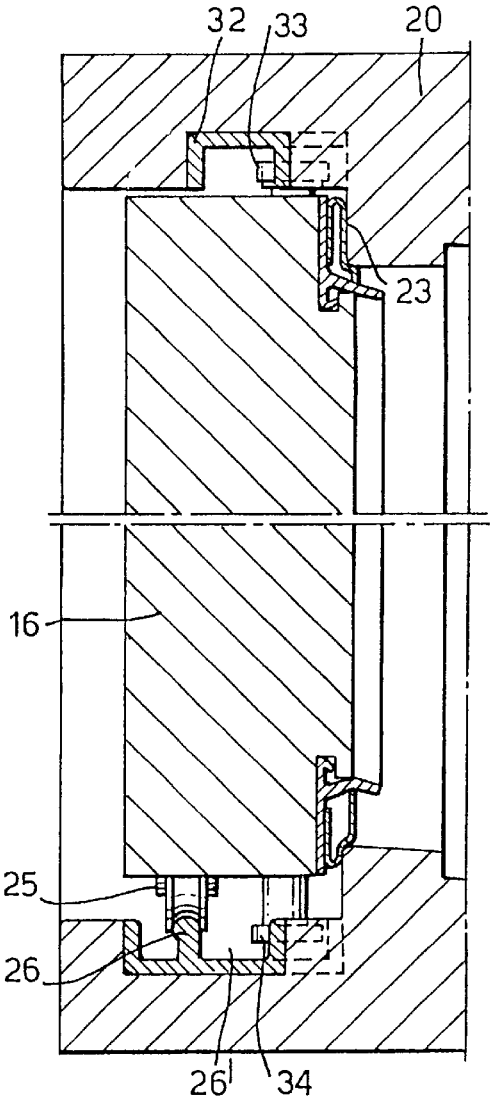
FIG. 48 shows the sliding panel of FIG. 46 adjusted to a maximum upper position relative to a frame structure.

As is shown in connection with FIGS. 46–48, there may be a need for height adjustment of a sliding panel in an opening in a frame structure, where for the sake of simplicity only the sill member 19 and head member 20 are shown. The adjustment may be necessary for purely aesthetic reasons, but may also be desirable owing to practical considerations such as the wind and the weather. FIG. 46 shows the sliding panel 16 in a typical intermediate position, whilst FIGS. 47 and 48 show the sliding panel in a lower position and an upper position respectively. To be able to carry out such a height adjustment in an efficient manner, according to the invention a technical solution is proposed which is evident in particular from FIGS. 42–45 and from the paragraphs below.

Although conceivably adjustability of just one carrying wheel could be used, it is proposed according to the invention to use a pair of carrying wheels 25, 25' close to the end portions of the sliding panels. The carrying wheels 25, 25' are arranged in a bogie, pivotally mounted in a fork 100. The fork 100 is movable in a pocket 101 in a carrying wheel housing 102. As previously described, the wheels 25, 25' are laterally movable along the axle 50, so that the sliding panel will be movable transverse to its longitudinal direction of movement when such movement is dictated by the guide castors and guide tracks or guide pins and guide tracks, as has also been shown and described earlier.

To prevent the fork 100 and the mounted wheels 25, 25' from falling out of the pocket 101 in the housing 102, the fork is provided on both sides with an elongate, vertical groove or slot 103 for sliding engagement with a peg 104 which extends into the gap 103 on each side of the opening 101. Uppermost, the fork 100 has a protuberant portion 105 having a specific outer radius of curvature. The height adjustment can be carried out with the aid of an adjusting disc which is eccentrically mounted and preferably has an asymmetric form in other respects. This disc is shown in more detail in FIG. 43 where it is indicated by means of the reference numeral 106. Along its periphery, the disc 106 recessed portions such as, e.g., the portions 106' and 106". These recessed portions 106" are preferably given the same radius of curvature as the protuberant portion 105 on the fork 100. When the disc 106 is turned about a support 107 with the aid of a turning tool 108 which can engage with a hole 109 in the mounting of the disc, it is possible to determine which of the recesses, e.g., 106' or 106", is to engage with the protuberance 105 on the fork 100. An examination of FIG. 43 will reveal that if the disc is turned clockwise, the fork 100 and so the wheels 25, 25' will move downwards relative to the bottom edge of the panel 16, whilst turning the disc counter-clockwise will cause the fork to move upwards in the housing 102. Extra locking of the height adjusting disc 106 is not necessary since the sliding panel rests with its weight on the connection between the protuberance 105 and the disc 106. Similarly, the curvature of the protuberance 105 and the recesses 106', 106" on the disc 106 are made so that the stepwise snap engagement for different height adjustments does not require particularly great maneuvering forces.

Figure 49:
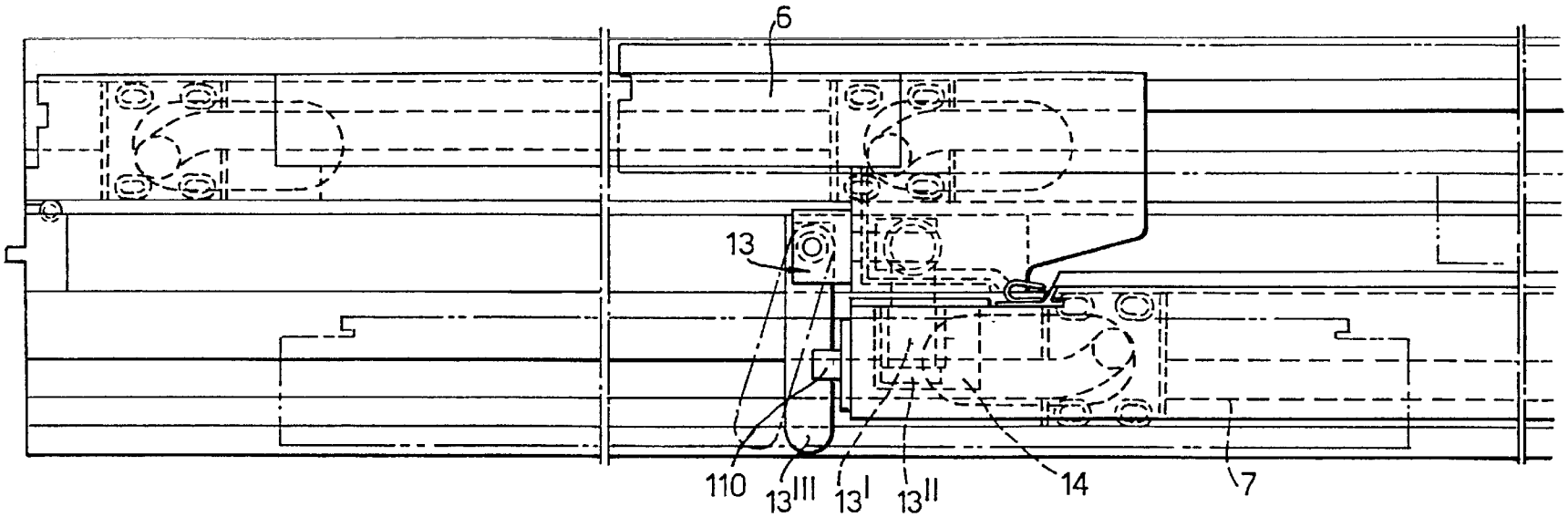
FIG. 49 shows how the two sliding panels, which are capable of moving relative to one another in a frame structure, may be locked together.
Figure 50:
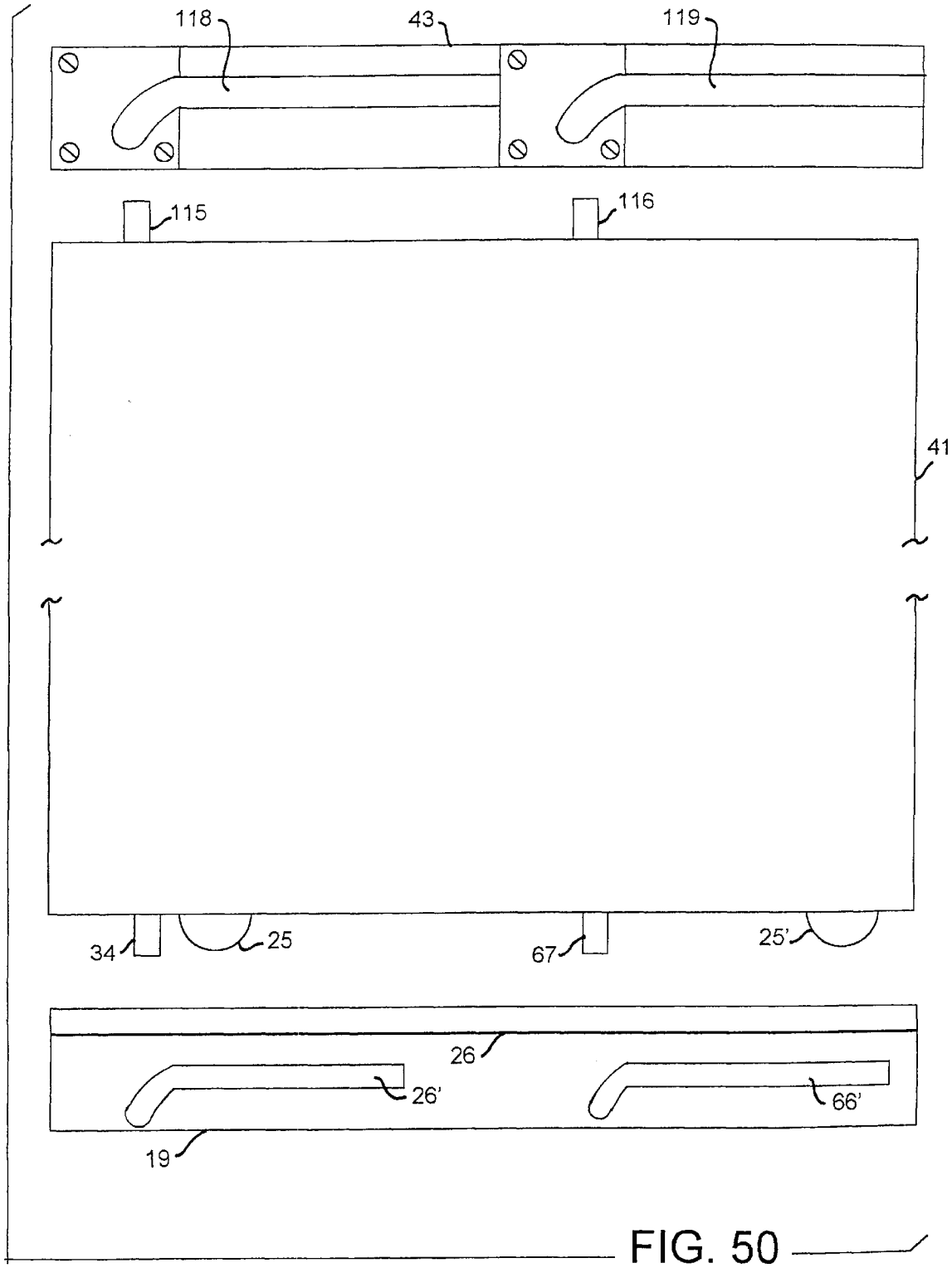
FIG. 50 is a simplified schematic view of an embodiment where the bottom face of the head member has two upper guide tracks one after the other which are each curved at one end thereof, the top of the sliding panel has two casters or pins for engaging the upper guide tracks, and the bottom of the sliding panel has two wheels for engaging a rail on the top face of the sill member and two casters or pins for engaging respective lower curved guide tracks in the top face of the sill member.
Figure 51:
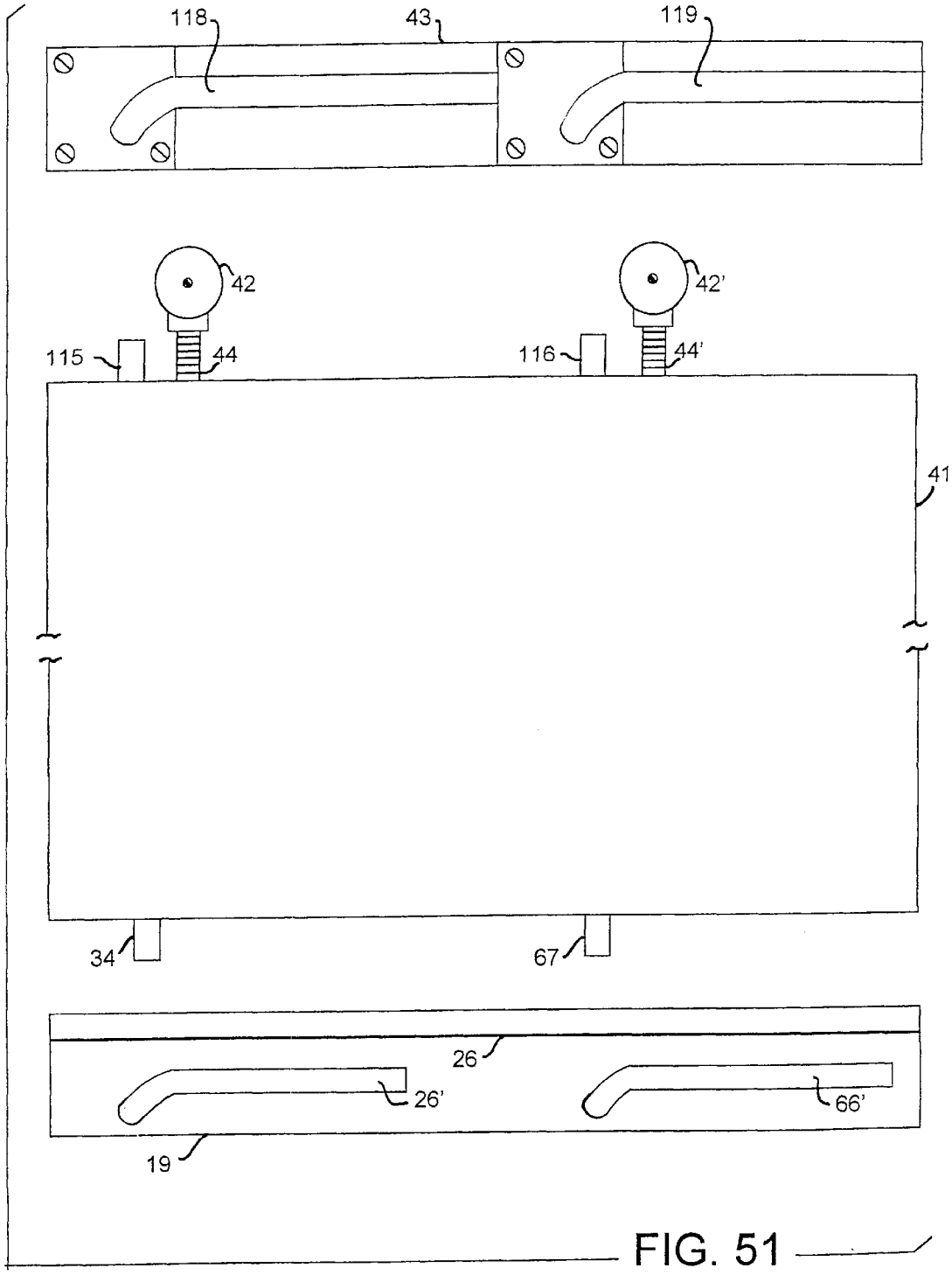
FIG. 51 is a simplified schematic view of an embodiment where the bottom face of the head member has two upper guide tracks one after the other which are each curved at one end thereof, the top of the sliding panel has two casters or pins for engaging the upper guide tracks as well as two wheels for hanging from the head member, and the bottom of the sliding panel has two casters or pins for engaging respective lower curved guide tracks in the top face of the sill member.

As shown and described in connection with FIG. 1, which shows in particular two sliding panels capable of moving relative to one another in a frame structure 1, a locking mechanism 13, 14 is proposed. This is shown in somewhat more exemplary detail in FIG. 49. The locking mechanism may consist of a dead bolt 13' having an expanded end portion 13" adapted to engage in the striking plate 14, and where the expanded portion 13" engages behind an edge of the striking plate 14, so that the bolt in this position cannot be withdrawn from the striking plate. The dead bolt is preferably movable through an angle of 90° with the aid of a handle 13'". The handle 13'" can optionally be locked in its position by means of a locking cam 110 which is found on the sliding panel 7 at the location of the striking plate.

The illustrated weather strip, e.g., the weather strip 23 on FIG. 3, may be made of soft rubber and with a fixing plate and weather moulding 23' of hard rubber. The seal tubing is secured uniformly to the weather moulding in order to provide a wall and prevent the infiltration of water, at the same time as the weather strip allows great height adjustability, as can be seen from FIGS. 46–48. Furthermore, the design of the weather strip permits sealing around all the corners of a sliding panel. The other vertically mountable portion of the weather strip is covered with the seal tubing, so that the last-mentioned can be lifted up and allow invisible nailing, as is indicated, for instance, on FIG. 36.

By using a turning piece construction as shown and described in connection with FIGS. 38–41, it will be possible, if so desired, to dispense with espagnolette locking for locking the sliding panel to the frame at the top and bottom thereof.

By making the frame structure with a rebate 114 in the centre, as is shown for instance in FIG. 31, it will be possible to allow the sliding panels in the transverse direction to be pressed and sealed against the rebate 114 from both the inside and the outside of the rebate. A frame profile of this kind has been found to be especially advantageous in connection with the present invention.

Thus, by means of the present invention there are provided technical solutions in connection with a sliding panel construction, whether one or more sliding panels are used in connection with a frame structure. Thus, by means of the invention there are provided adjustable fittings which handle the final guiding (the transverse movement of the sliding panel) and where there is also the possibility of adjusting the pressure on the seal which the sliding panel must have at all four corners. In actual fact, each corner of the sliding panel is separately adjustable. Moreover, the present invention is of a design that is simple in mechanical construction, has few movable parts and requires minor modifications of the frame structure and the sliding panel. As shown in connection with the locking device, the striking plate is adjustable, so that a controlled pressure on the seal is obtained.

What is claimed is:

1. A sliding panel and a frame structure in combination for providing longitudinal movement of the sliding panel in the frame structure, and simultaneous lateral movement of the sliding panel as the sliding panel approaches a vertical portion of the frame structure which a leading portion of said sliding panel engages to close an opening in the frame structure, comprising;

wheels provided on an underside of the sliding panel at first and second end portions of the sliding panel;

a sill member of the frame structure having:

two sill guide tracks positioned one after the other in a longitudinal direction for providing said longitudinal and lateral movements of the sliding panel, said sill guide tracks being curved at end portions thereof closest to said vertical portion of the frame structure, said curved end portions being provided to cause said lateral movement, and a supporting rail for supporting the wheels of the sliding panel, said supporting rail extending only in said longitudinal direction, a head member of the frame structure having:

two head member guide tracks positioned one after the other in the longitudinal direction for providing said longitudinal and lateral movements of the sliding panel, said head member guide tracks being curved at end portions thereof closest to said vertical portion of the frame structure for providing said lateral movement;

each of said wheels being rotatably mounted on a respective horizontal wheel axle disposed at the underside of said panel, said wheels being laterally movable along said respective axle between ends of the respective axle as a means for guiding said sliding panel engage said end portions of said guide tracks to provide said lateral movement of the sliding panel.

2. A combination in accordance with claim 1, wherein said means for guiding said sliding panel comprise:

first and second guide elements provided at a top of the sliding panel at said first and second end portions of the sliding panel, respectively, said first guide element adapted to be guided by one of said head member guide tracks and said second guide element adapted to be guided by the other of said head member guide tracks; and third and fourth guide elements provided at said underside of the sliding panel at said first and second end portions of the sliding panel, respectively, said third guide element adapted to be guided by one of said sill guide tracks and said forth guide element adapted to be guided by the other of said sill guide tracks.

3. A combination in accordance with claim 2 wherein the guide elements comprise castors which are operatively associated with an espagnolette lock fitting for the sliding panel.

4. A combination in accordance with claim 2, wherein the guide elements are height adjustable.

5. A combination in accordance with claim 2, wherein each guide element comprises one of:

(i) a pin, (ii) a castor.

6. A combination in accordance with claim 2, wherein said third and fourth guide elements comprise castors having a vertical axis of rotation.

7. A combination in accordance with claim 2, wherein the guide elements comprise castors having a vertical axis of rotation and are spring-biased.

8. A combination in accordance with claim 2, wherein the guide elements comprise castors having a vertical axis of rotation and a clearance relative to a respective one of the guide tracks.

9. A combination in accordance with claim 1, wherein:

at least one of the wheels is arranged in a bogie which is height adjustable, and a top portion of the bogie comprises a support site for an adjustable disc mounted in the sliding panel, a periphery of the disc having a plurality of support seats for selective engagement with said top portion, and said support seats being spaced different distances from a mounting center of the disc.

10. A combination in accordance with claim 1, wherein the sliding panel is movable in the frame structure relative to a stationary panel in the frame structure, said sliding panel comprising a male part intended for engagement with a female part disposed in said stationary panel, said female part having a mouth and a recess that is oblique relative to said mouth, a portion of the mouth being rounded and closer to a bottom of the recess than other portions of the mouth, and the male comprising an attachment piece having a protecting pin that is oblique relative to said attachment piece and said longitudinal direction, said pin being adapted to move into and out of said recess during said longitudinal and lateral movements of the sliding panel.

11. A combination in accordance with claim 1, wherein the sliding panel comprises a first sliding panel movable in the frame structure relative to a second sliding panel movable in the frame structure, said first sliding panel comprising:

a male part intended for engagement with a female part disposed in said second sliding panel, said female part having a mouth and a recess that is oblique relative to said mouth, a portion of the mouth being rounded and closer to a bottom of the recess than other portions of the mouth, and the male part comprising an attachment piece having a projecting pin that is oblique relative to the attachment piece said longitudinal directions and to said pin being adapted to move into and out of said recess during said longitudinal and lateral movements of said first sliding panel.

12. A sliding panel and a frame structure in combination for providing longitudinal movement of the sliding panel in the frame structure, and simultaneous lateral movement of the sliding panel as the sliding panel approaches a vertical portion of the frame structure which a leading portion of said sliding panel engages to close an opening in the frame structure, comprising:

first and second mounting elements at respective first and second top end portions of the sliding panel;

a lower guide element provided on a sill member of the frame structure, a lower guide track positioned in an underside of said sliding panel for engaging said lower guide element to provide said longitudinal and lateral movements of the sliding panel, said lower guide track being curved, for effecting said lateral movement, at an end portion thereof furthest from said vertical portion of the frame structure;

two pairs of wheels, each pair being rotatably mounted on a respective horizontal axle, said wheels being rollably mounted on a head member of the frame structure, one of said pair of wheels connected to said sliding panel via said first mounting element and the other of said pair of wheels connected to said sliding panel via said second mounting element, each of said mounting elements being slidably movable along a respective one of the axles between the pair of wheel is; and an upper guide track positioned in said head member for engaging a corresponding upper guide element provided at a top of the sliding panel, said upper guide track being curved, for effecting said lateral movement, at an end portion thereof closest to said vertical portion of the frame structure.

13. A combination in accordance with claim 12, wherein the guide elements comprise castors which are operationally associated with an espagnolette lock fitting for the sliding panel.

14. A combination in accordance with claim 12, further comprising means for laterally guiding said leading portion of the sliding panel, in order to provide a sealing contact of the leading portion with the frame structure.

15. A combination in accordance with claim 14, wherein said means for laterally guiding comprises a turning piece that is pivotable to guide said leading portion into said sealing contact.

16. A combination in accordance with claim 12, wherein:

said lower guide element comprises two lower guide elements provided on said sill member;

said lower guide track comprises two lower guide tracks positioned in said underside of said sliding panel for engaging said two lower guide tracks are positioned one after the other in a longitudinal direction for guiding said longitudinal and lateral movements of the sliding panel.

17. A combination in accordance with claim 12, wherein:

said upper guide element comprises two upper guide elements provided on said sliding panel;

said upper guide track comprises two upper guide tracks positioned in said head member for engaging said upper guide elements; and said two upper guide tracks are positioned one after the other in a longitudinal direction for guiding said longitudinal and lateral movements of the sliding panel.

18. A combination in accordance with claim 12, wherein each guide element comprises one of:

(i) a pin, (ii) a castor.

19. A combination in accordance with claim 12, wherein the guide elements are height adjustable.

20. A combination in accordance with claim 12 wherein the guide elements comprise castors having a vertical axis of rotation and a clearance relative to a respective one of said guide tracks.

21. A sliding panel and a frame structure in combination for providing longitudinal movement of the sliding panel in the frame structure, and simultaneous lateral movement of the sliding panel as the sliding panel approaches a vertical portion of the frame structure which a leading portion of said sliding panel engages to close an opening in the frame structure, comprising:

first and second mounting elements at respective first and second top end portions of the sliding panel;

first and second lower guide elements provided on an underside of said sliding panel;

first and second lower guide tracks positioned in a sill member of the frame structure for engaging said first and second lower guide elements, respectively, to provide said longitudinal and lateral movements of the sliding panel, said lower guide tracks positioned one after the other in a longitudinal direction and being curved at respective ends thereof for effecting said lateral movement;

two pairs of wheels, each pair being rotatably mounted on a respective horizontal axle and being rollably mounted on a head member of the frame structure, one of said pair of said wheels connected to said sliding panel via said first mounting element and the other of said pair of wheels connected to said sliding panel via said second mounting element, each of said mounting elements being slidably movable along a respective one of the axles between the pair of wheels: and first and second upper guide tracks positioned in said head member for engaging first and second upper guide elements respectively provided at a top of the sliding panel, said upper guide tracks positioned one after the other in the longitudinal direction and being curved at respective ends thereof for effecting said lateral movement.

22. A combination in accordance with claim 21, wherein the guide elements comprise castors having a vertical axis of rotation and a clearance relative to said respective guide tracks.

23. A combination in accordance with claim 21 wherein said first and second mounting elements are laterally movable along said respectively one of said horizontal axles.

24. A combination in accordance with claim 21, wherein each guide element comprises one of:

(i) a pin, (ii) a castor.

25. A combination in accordance with claim 21 wherein the guide elements comprise castors which are operationally associated with an espagnolette lock fitting for the sliding panel.

26. A combination in accordance with claim 21, wherein the guide elements are height adjustable.

27. A sliding panel and a frame structure in combination for providing longitudinal movement of the sliding panel in the frame structure, and simultaneous lateral movement of the sliding panel as the sliding panel approaches a vertical portion of the frame structure which a leading portion of said sliding panel engages to close an opening in the frame structure, comprising:

first and second mounting elements at respective first and second top end portions of the sliding panel, first and second lower guide elements provided on a sill member of the frame structure;

a first lower guide track positioned in an underside of said sliding panel for engaging said first lower guide element to provide said longitudinal and lateral movements of the sliding panel, said first lower guide track being curved, for effecting said lateral movement, in a region of a forward end portion of the sliding panel;

a second lower guide track positioned in the underside of said sliding panel for engaging said second lower guide element to provide said longitudinal and lateral movements of the sliding panel, said second lower guide track being curved, for effecting said lateral movement, in a region between the first lower guide track and a rear edge of the sliding panel;

two pairs of wheels, each pair being rotatably mounted on a respective horizontal axle, said wheels being rollably mounted on a head member of the frame structure, one of said pair of wheels connected to said sliding panel via said first mounting element and the other of said pair of wheels connected to said sliding panel via said second mounting element, each of said mounting elements being slidably moveable along a respective one of the axles between the pair of wheels;

a first upper guide track positioned in said head member for engaging a corresponding first upper guide element provided at a top of the sliding panel, said first upper guide track being curved, for effecting said lateral movement, at an end portion thereof closest to said vertical portion of the frame structure; and a second upper guide track positioned in said head member for engaging a corresponding second upper guide element provided at the top end of the sliding panel, said second upper guide track being curved, for effecting said lateral movement, at an end portion thereof closest to said vertical portion of the frame structure.

28. A combination in accordance with claim 27, wherein the guide elements are height adjustable.

29. A combination in accordance with claim 27, wherein the guide elements comprise castors which are operationally associated with an espagnolette lock fitting for the sliding panel.

30. A combination in accordance with claim 27, wherein the guide elements comprise castors having a vertical axis of rotation and a clearance relative to a respective one of guide tracks.

31. A combination in accordance with claim 27, wherein each guide element comprises one of;

(i) a pin, (ii) a castor.

32. A combination in accordance with claim 27 wherein said first and second mounting elements are laterally movable along said respective one of said horizontal axles.

33. A combination in accordance with claim 27, wherein:

said first and second upper guide tracks are positioned one after the other in a longitudinal direction; and said first and second lower guide tracks are positioned one after the other in said longitudinal direction.

34. A locking device for a sliding panel movable in a frame structure, said locking device having a lock case with a dead bolt adapted for a turning movement through about 90° and a striking plate, wherein:

an outer end of the dead bolt has a thickened portion;

the striking plate has a bolt insertion opening consisting of a first and a second portion;

the first portion has a minimum width dimension that is wider than a corresponding maximum width dimension of said thickened portion;

the first portion merges into the second portion which along a substantial part of a length of said second portion is inclined relative to a longitudinal axis of said striking plate and has a width that is greater than a diameter of the maximum with dimension of said bolt, but smaller than the thickened portion of the bolt; the striking plate includes a front portion positioned to face toward the sliding panel and a back positioned to face away from the sliding panel, said back includes a curved contact portion facing away from said front portion for engaging the thickened portion of the bolt;

the contact portion extends along said second portion of the insertion opening; and the striking plate at the first portion of the insertion opening has an oblique slide plate extending away from said back of said striking plate and comprises a sliding contact for the thickened portion of the bolt when said thickened portion is moved in or out of the striking plate;

wherein during a movable engagement of the bolt with the striking plate, the lock case movers both:

(i) in a direction towards the striking plate, and (ii) in a lateral direction with respect to said striking plate.

35. A locking device in accordance with claim 34, wherein said contact portion is adjustably mounted to said striking plate.

36. A locking device in accordance with claim 34, wherein the bolt is articulately connected in the lock case to an espagnolette mechanism.

37. A locking device in accordance with claim 36, wherein the espagnolette mechanism has bolts each having a chamfered portion intended for interaction with a respective striking plate that is mountable in one of a head and sill member of the frame structure, said espagnolette striking plates each having adjustable guides for the espagnolette mechanisms bolts, said guides each consist of two rotating balls and are adapted to simultaneously guide the sliding panel forward toward said front portion and sideways with respect to said front portion when a respective one of the bolts is inserted into the respective espagnolette mechanism striking plate.

38. A locking device in accordance with claim 34, wherein the sliding panel is movable relative to a fixed element which comprises part of the frame structure.

39. A locking device in accordance with claim 34, wherein the sliding panel is movable relative to a second sliding panel which is movable in the frame structure.

* * * * *